US007711302B2

(12) United States Patent
Ueda

(10) Patent No.: US 7,711,302 B2
(45) Date of Patent: May 4, 2010

(54) IMAGE FORMING APPARATUS

(75) Inventor: Hiroki Ueda, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 317 days.

(21) Appl. No.: 11/952,418

(22) Filed: Dec. 7, 2007

(65) Prior Publication Data

US 2009/0072468 A1 Mar. 19, 2009

(30) Foreign Application Priority Data

Jan. 29, 2007 (JP) ..... 2007-017856

(51) Int. Cl.
*G03G 15/20* (2006.01)

(52) U.S. Cl. ..... 399/327; 399/389; 271/9.05

(58) Field of Classification Search ..... 399/18, 399/20, 21, 320, 327, 389; 271/9.05
See application file for complete search history.

(56) References Cited

U.S. PATENT DOCUMENTS 5,978,612 A * 11/1999 Suzuki et al. ..... 399/16
2004/0184058 A1* 9/2004 Miyajima ..... 358/1.12
2008/0175614 A1* 7/2008 Miyazaki ..... 399/68
2008/0199197 A1* 8/2008 Suzuki et al. ..... 399/67

FOREIGN PATENT DOCUMENTS

JP 2006-154192 6/2006
JP 2006154192 A * 6/2006

* cited by examiner

*Primary Examiner*—David P Porta
*Assistant Examiner*—Mark R Gaworecki
(74) *Attorney, Agent, or Firm*—Cantor Colburn LLP

(57) ABSTRACT

Disclosed is an image forming apparatus including: a sheet feeding tray to store a sheet; an image forming section to form an image on the sheet; a fusing section to fuse the image; a controlling section to perform cleaning of the fusing section when a sheet has been nipped in the fusing section at an occurrence of a jam by passing a sheet through the fusing section after the jam is relieved; an operating section to set an allowed condition of a sheet; and a memory section to store an allowed condition, wherein the controlling section determines whether the sheet feeding tray stores a sheet which satisfies the allowed condition, and when the sheet feeding tray stores the sheet which satisfies the allowed condition, selects the sheet feeding tray and controls the sheet feeding tray to feed the sheet and controls the fusing section to pass the sheet.

4 Claims, 16 Drawing Sheets

FIG.2A

141

| No. | TRAY | SHEET TYPE | BASIS WEIGHT | PUNCHED HOLE | ··· |
|---|---|---|---|---|---|
| 1 | SHEET FEEDING TRAY 66A | PLAIN SHEET | 75-80g/m$^2$ | NONE | ··· |
| 2 | SHEET FEEDING TRAY 66B | COATED SHEET GL | 136-162g/m$^2$ | NONE | ··· |
| 3 | SHEET FEEDING TRAY 66C | HIGH QUALITY SHEET | 64-74g/m$^2$ | NONE | ··· |

FIG.2B

142

| SHEET TYPE | BASIS WEIGHT | PUNCHED HOLE | INDEX SHEET | COLOR SHEET |
|---|---|---|---|---|
| PLAIN SHEET | 64-74g/m$^2$ | ALLOWED | — | ALLOWED |
| HIGH QUALITY SHEET | 75-80g/m$^2$ | | | |
| — | 81-105g/m$^2$ | | | |
| — | 106-135g/m$^2$ | | | |
| ⋮ | ⋮ | | | |

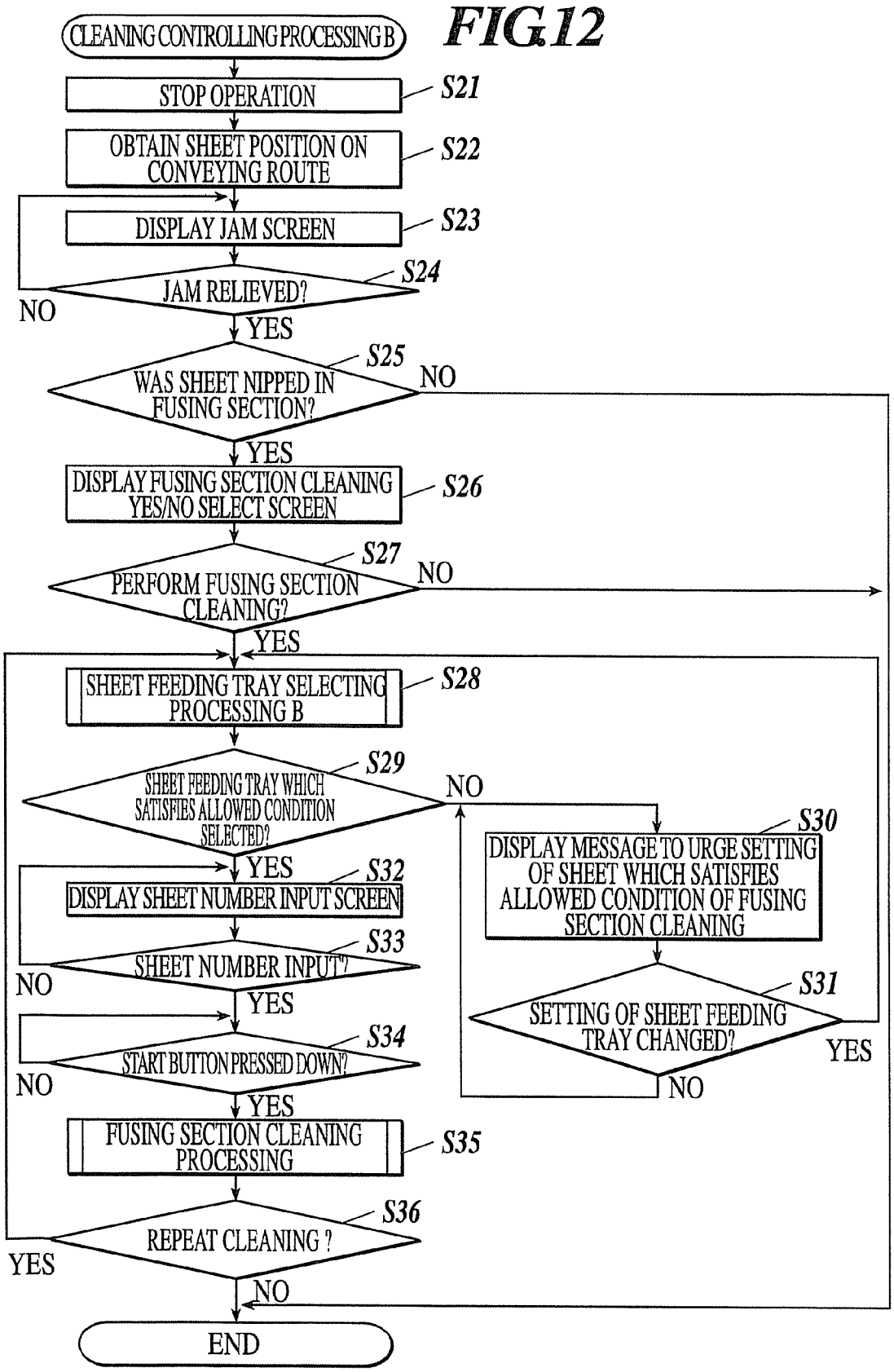
FIG.12
CLEANING CONTROLLING PROCESSING B
STOP OPERATION
S21
OBTAIN SHEET POSITION ON CONVEYING ROUTE
S22
DISPLAY JAM SCREEN
S23
JAM RELIEVED?
S24
NO
YES
WAS SHEET NIPPED IN FUSING SECTION?
S25
NO
YES
DISPLAY FUSING SECTION CLEANING YES/NO SELECT SCREEN
S26
PERFORM FUSING SECTION CLEANING?
S27
NO
YES
SHEET FEEDING TRAY SELECTING PROCESSING B
S28
SHEET FEEDING TRAY WHICH SATISFIES ALLOWED CONDITION SELECTED?
S29
NO
YES
DISPLAY MESSAGE TO URGE SETTING OF SHEET WHICH SATISFIES ALLOWED CONDITION OF FUSING SECTION CLEANING
S30
SETTING OF SHEET FEEDING TRAY CHANGED?
S31
YES
NO
DISPLAY SHEET NUMBER INPUT SCREEN
S32
SHEET NUMBER INPUT?
S33
NO
YES
START BUTTON PRESSED DOWN?
S34
NO
YES
FUSING SECTION CLEANING PROCESSING
S35
REPEAT CLEANING ?
S36
YES
NO
END

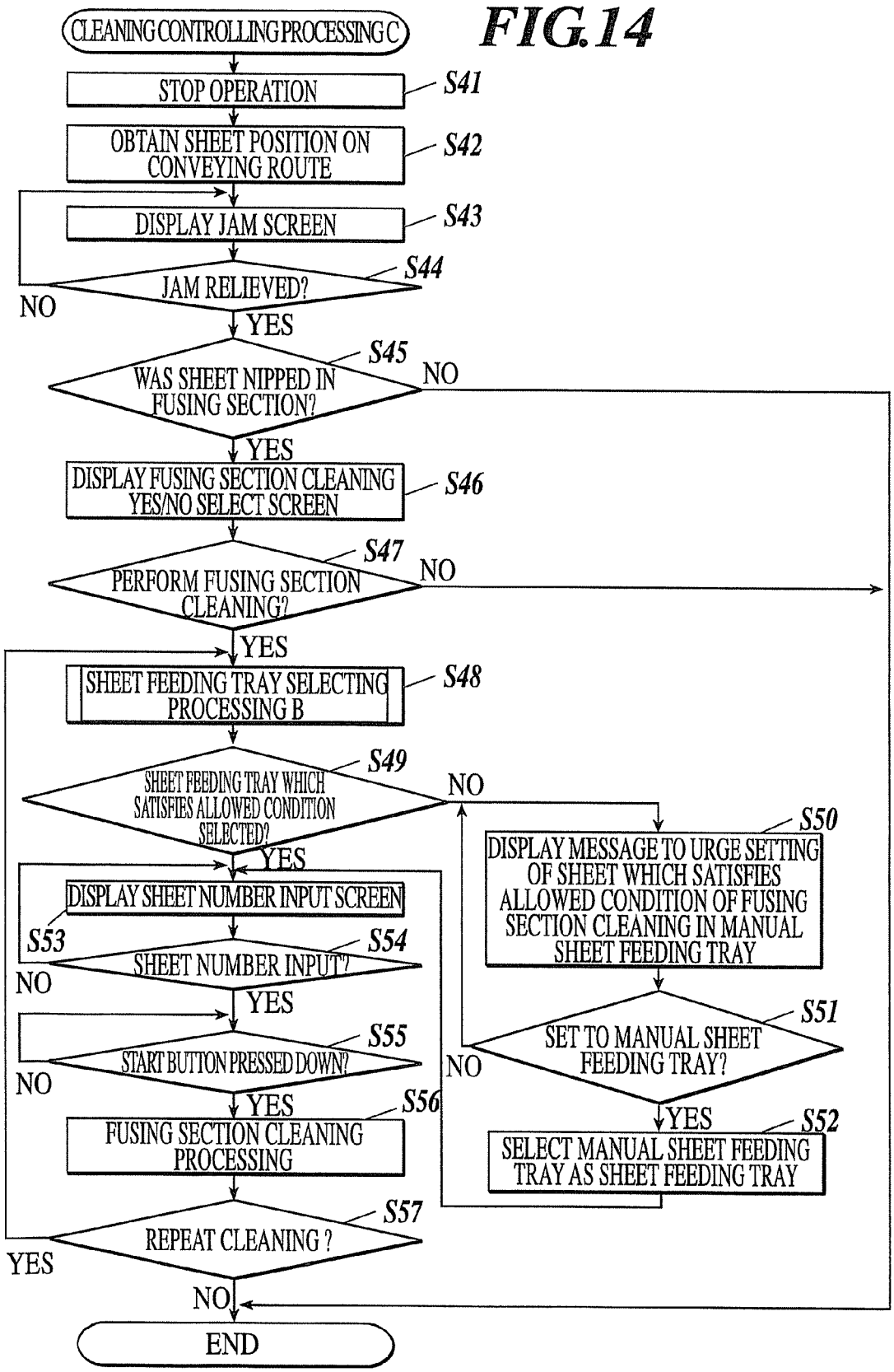
FIG.14
CLEANING CONTROLLING PROCESSING C
STOP OPERATION
S41
OBTAIN SHEET POSITION ON CONVEYING ROUTE
S42
DISPLAY JAM SCREEN
S43
JAM RELIEVED?
S44
NO
YES
WAS SHEET NIPPED IN FUSING SECTION?
S45
NO
YES
DISPLAY FUSING SECTION CLEANING YES/NO SELECT SCREEN
S46
PERFORM FUSING SECTION CLEANING?
S47
NO
YES
SHEET FEEDING TRAY SELECTING PROCESSING B
S48
SHEET FEEDING TRAY WHICH SATISFIES ALLOWED CONDITION SELECTED?
S49
NO
YES
DISPLAY MESSAGE TO URGE SETTING OF SHEET WHICH SATISFIES ALLOWED CONDITION OF FUSING SECTION CLEANING IN MANUAL SHEET FEEDING TRAY
S50
SET TO MANUAL SHEET FEEDING TRAY?
S51
NO
YES
SELECT MANUAL SHEET FEEDING TRAY AS SHEET FEEDING TRAY
S52
DISPLAY SHEET NUMBER INPUT SCREEN
S53
SHEET NUMBER INPUT?
S54
NO
YES
START BUTTON PRESSED DOWN?
S55
NO
YES
FUSING SECTION CLEANING PROCESSING
S56
REPEAT CLEANING ?
S57
YES
NO
END

IMAGE FORMING APPARATUS

BACKGROUND

1. Field of the Invention

The present invention relates to an image forming apparatus which includes a function of cleaning a fusing section by passing a sheet on which an image is not formed, before resuming printing after relieving a jam, when a sheet is nipped in a fusing section at the time of an occurrence of the jam.

2. Description of Related Art

In an image forming apparatus such as a copier or a printer using electrophotography which transfers toner images on a sheet and heat-melts and fixes the transferred toner images fusing section cleaning methods have been proposed where, when a sheet may be nipped in a nip section of a fusing section when a jam occurs, a sheet on which an image has not been formed is passed through the fusing section after the jam is settled and before resuming printing, and toner adhered on a surface of the fusing section is transferred to the passed sheet so that the residual toner is removed.

For example, a technique is proposed such as when a printing operation is interrupted by a jam occurrence, etc., if a sheet may be nipped in a nip section of the fusing section at the time, a sheet with a same sheet size or larger and a smaller basis weight than the sheet used in the interrupted printing is chosen from the sheet storing section, and is fed through a fusing roller and pressure roller without forming an image after jam processing, so that residual adhered toner on the rollers are transferred and adhered to the passed sheet and the sheet is ejected to a sheet ejection tray different from the tray where the printed sheet is ejected (For example Japanese Patent Application Laid-open Publication No. 2006-154192, hereinafter referred to as Patent Document 1).

However, with the method of Patent Document 1, sheets which meet the above mentioned size condition and basis weight condition are automatically fed and passed from the sheet storing section. As a result, when size condition and basis weight condition are satisfied, even expensive special sheets such as coated sheets and high quality sheets which a user does not desire to use for cleaning may be used for cleaning.

SUMMARY

The present invention has been made in consideration of the above problems, and it is one of main objects to provide a technique to prevent expensive sheets and special sheets set in a sheet feeding tray from being unnecessarily used for cleaning a fusing section.

An image forming apparatus reflecting one aspect of the present invention comprises:

a sheet feeding tray to store a sheet;

an image forming section to form a toner image on the sheet fed from the sheet feeding tray;

a fusing section to fuse the toner image on the sheet;

a controlling section to perform cleaning of the fusing section when a sheet has been nipped in the fusing section at a time of occurrence of a jam by passing a sheet from the sheet feeding tray through the fusing section after the jam is relieved;

an operating section to set an allowed condition including a sheet type and basis weight of an allowed sheet to be used for cleaning the fusing section; and a memory section to store the allowed condition including the sheet type and basis weight set on the operating section, wherein the controlling section determines whether or not the sheet feeding tray stores a sheet which satisfies the allowed condition stored in the memory section when cleaning of the fusing section is performed, and when the sheet feeding tray stores the sheet which satisfies the allowed condition, the controlling section selects the sheet feeding tray and controls the sheet feeding tray to feed the sheet from the selected sheet feeding tray and controls the fusing section to pass the sheet through the fusing section.

An image forming apparatus reflecting another aspect of the present invention comprises:

a sheet feeding tray to store a sheet;

an image forming section to form a toner image on the sheet fed from the sheet feeding tray;

a fusing section to fuse the toner image on the sheet;

a controlling section to perform cleaning of the fusing section when a sheet has been nipped in the fusing section at a time of occurrence of a jam by passing a sheet from the sheet feeding tray through the fusing section after the jam is relieved;

an operating section to set a prohibited condition including a sheet type and basis weight of a prohibited sheet not to be used for cleaning the fusing section; and a memory section to store the prohibited condition including the sheet type and basis weight set on the operating section, wherein the controlling section determines whether or not the sheet feeding tray stores a sheet which does not fall into the prohibited condition stored in the memory section when cleaning of the fusing section is performed, and when the sheet feeding tray stores the sheet which does not fall into the prohibited condition, the controlling section selects the sheet feeding tray and controls the sheet feeding tray to feed the sheet from the selected sheet feeding tray and controls the fusing section to pass the sheet through the fusing section.

According to the above aspects of the invention, when a cleaning of a fusing section is performed, a sheet which satisfies an allowed condition such as sheet type, basis weight, etc. set on the operating section is automatically fed from the sheet feeding tray which stores the sheet and passed to the fusing section. Consequently, even when expensive sheets and special sheets which a user does not desire to use for cleaning the fusing section are stored in any of the sheet feeding sections, such sheets can be prevented from being unnecessarily used when cleaning the fusing section.

BRIEF DESCRIPTION OF THE DRAWINGS

These and other objects, advantages and features of the present invention will become more fully understood from the detailed description given hereinbelow and the appended drawings, and thus are not intended as a definition of the limits of the present invention, and wherein;

FIG. 2A is a diagram showing an example of data storage in a tray file;

FIG. 2B is a diagram showing an example of data storage in a cleaning allowed condition file;

FIG. 12 is a flow chart showing a cleaning controlling processing B performed by the controlling section shown in FIG. 1;

FIG. 14 is a flow chart showing a cleaning controlling processing C performed by the controlling section shown in FIG. 1;

DETAILED DESCRIPTION OF PREFERRED EMBODIMENTS

First Embodiment

A first embodiment of the present invention will be described in detail below with reference to the drawings.

First, a structure is described.

Figure 1:
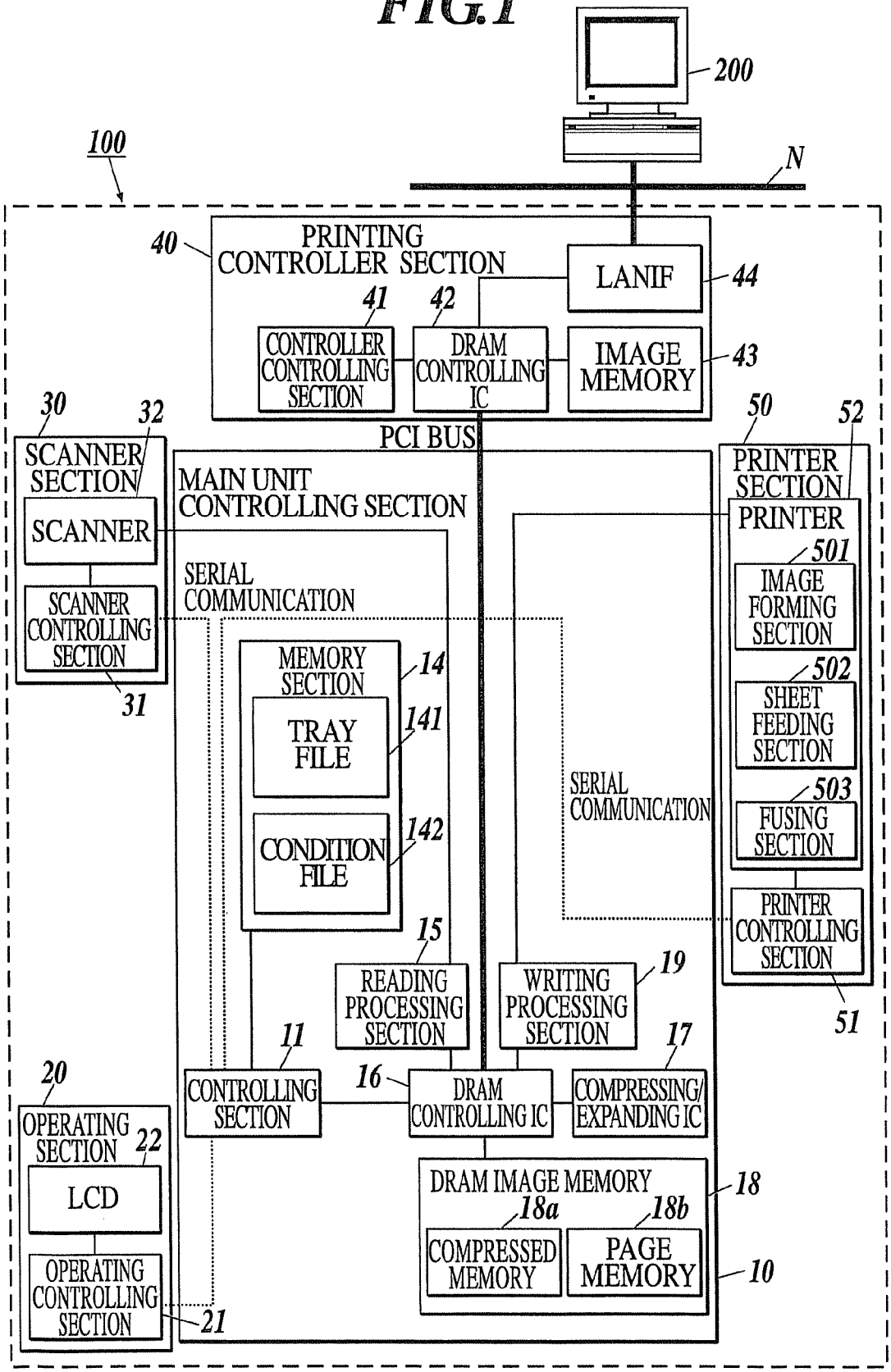
FIG. 1 is a block diagram showing a functional structure of an image forming apparatus of the present embodiment.

FIG. 1 shows an example of a functional structure of an image forming apparatus 100 of the present embodiment. As shown in FIG. 1, the image forming apparatus 100 includes a main unit controlling section 10, an operating section 20, a scanner section 30, a printing controller section 40, and a printer section 50.

The main unit controlling section 10 includes a controlling section 11, a memory section 14, a reading processing section 15, a DRAM (Dynamic Random Access Memory) controlling IC 16, a compressing/expanding IC 17, a DRAM image memory 18, a writing processing section 19, and the like.

The controlling section 11 includes a CPU (Central Processing Unit), a ROM (Read Only Memory), a RAM (Random Access Memory) and the like. The CPU of the controlling section 11 reads various processing programs such as a cleaning controlling processing program and a sheet feeding tray selecting program stored in the ROM and develops them to a work area of the RAM. Then, according to the developed programs, the CPU centrally controls operations of the sections of the image forming apparatus 100 and performs various processing such as the later described cleaning controlling processing and sheet feeding tray selecting processing.

The memory section 14 includes a nonvolatile memory and the like and stores a tray file 141 which stores setting information of a sheet feeding tray, a condition file 142 which stores a cleaning allowed condition, and the like according to instructions from the controlling section FIG. 2A shows an example of data storage in the tray file 141. As shown in FIG. 2A, the tray file 141 stores information on the sheet including sheet type (for example, plain sheet, coated sheet GL, high quality sheet), basis weight (for example, 75-80 g/m$^2$, 136-162 g/m$^2$, 64-74 g/m$^2$) and presence of punched hole (for example, none, . . . ) stored in each sheet feeding tray. The tray file 141 is setting information set and input through a tray setting screen (not shown) displayed on the operating section 20 according to a predetermined operation.

FIG. 2B shows an example of data storage in the condition file 142. The condition file 142 stores conditions of sheets allowed to be used in cleaning the fusing section, which are set and input from a cleaning allowed condition setting screen 220 (see FIG. 3) displayed on the operating section 20 according to a predetermined operation. For example, as shown in FIG. 2B, the file includes items "sheet type", "basis weight", "punched hole", "index sheet", "color sheet", etc. In the item "sheet type", the type of sheet (for example, plain sheet and high quality sheet) allowed to be used for cleaning the fusing section is stored. In the item "basis weight", the basis weight (for example, 64-74 g/m$^2$, 75-80 g/m$^2$, 81-105 g/m$^2$, and 106-135 g/m$^2$) of the sheet allowed to be used for cleaning the fusing section is stored. In the items "punched hole", "index sheet" and "color sheet", information on allowed condition for each item (for example, "allowed") when such sheets used for cleaning the fusing section is stored.

The reading processing section 15 converts analog image signals read by the scanner section 30 to RGB image data then performs image processing such as converting RGB image data to CMYK image data and outputs the data to the DRAM controlling IC 16.

Based on control by the controlling section 11, the DRAM controlling IC 16 allows the compressing/expanding IC 17 to compress image data input from the reading processing section 15 and image data input from the printing controller section 40, then writes the compressed image data on the compressed memory 18*a* of the DRAM image memory 18 so as to temporarily store the image data. When there is an instruction from the controlling section 11 to output image data, the DRAM controlling IC 16 allows the compressing/expanding IC 17 to expand the image data instructed to be output which is stored in the compressed memory 18*a*, and stores the expanded image data in a page memory 18*b*. Then according to an instruction from the controlling section 11, the image data stored in the page memory 18*b* is read and output to the reading processing section 19.

The compressing/expanding IC 17 performs compressing processing and expanding processing of image data according to control by the DRAM controlling IC 16.

The DRAM image memory 18 is configured with a DRAM and includes the compressed memory 18*a* and the page memory 18*b*. According to control by the DRAM controlling IC 16, the compressed memory 18*a* temporarily stores image data compressed in the compressing/expanding IC 17. The page memory 18*b* temporarily stores image data expanded in the compressing/expanding IC 17.

The writing processing section 19 generates PWM (Pulse Width Modulation) signals according to image data input from compressing/expanding IC 17 and outputs the signals to printer section 50.

The operating section 20 includes an operating controlling section 21 and an LCD (Liquid Crystal Display) 22.

The operating controlling section 21 receives display signals from the controlling section 11 and controls the display of the LCD 22. The operating controlling section 21 outputs to the controlling section 11 operating signals input from a touch panel on the LCD 22.

The LCD 22 displays various operating screens, status of image, operation status of each function and the like according to instructions input as display signals from the operating controlling section 21. On the screen of the LCD 22, a pressure sensitive type (resistive film type) touch panel is provided in which transparent electrodes are arranged in a grid-like pattern, and an XY coordinate of a point pushed down with a finger or a touch pen, etc. is detected with a voltage level so as to output the detected location signal as an operating signal to the operating controlling section 21.

Figure 3:
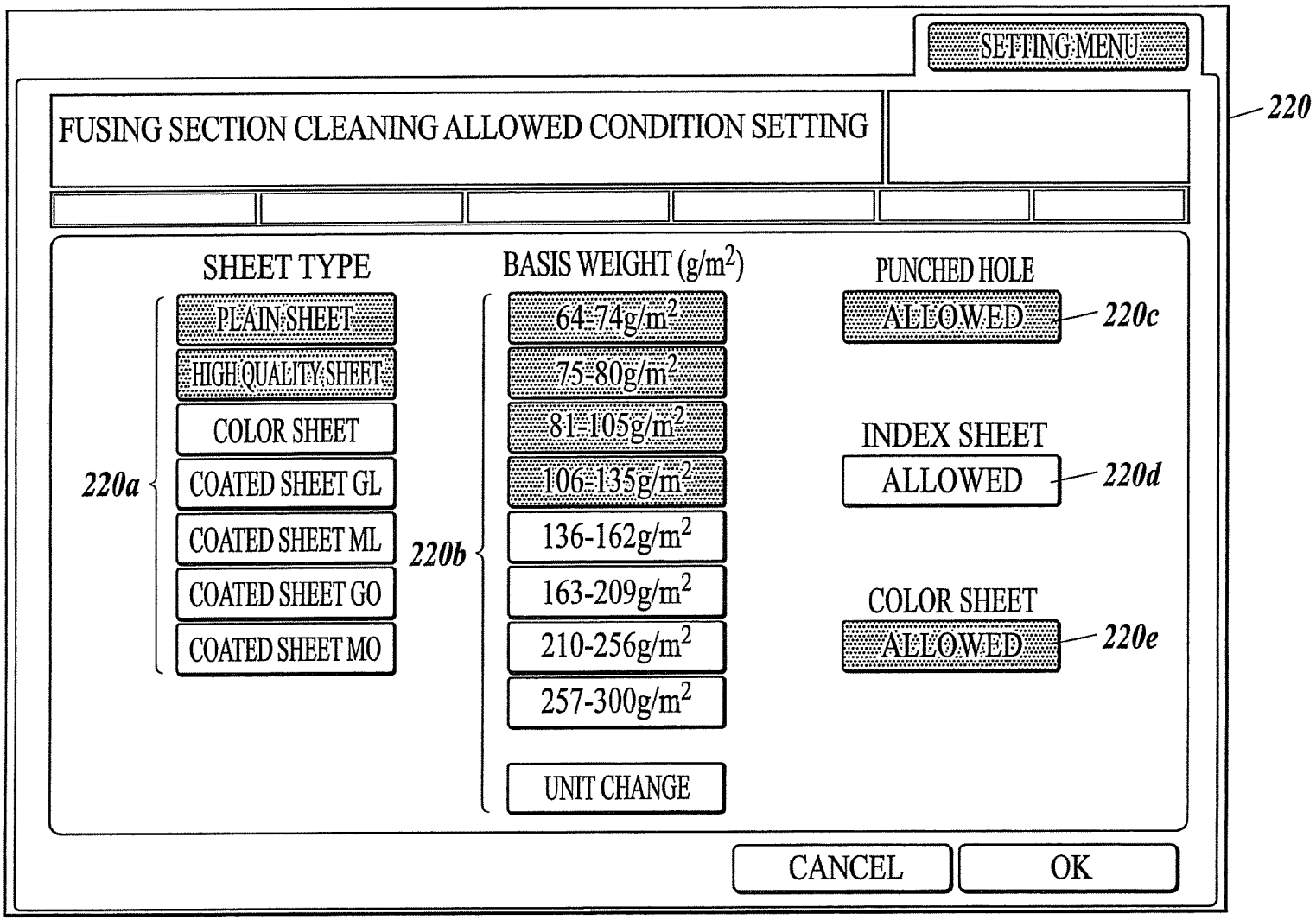
FIG. 3 is a diagram showing an example of a condition setting screen for setting cleaning allowed conditions displayed on an LCD shown in FIG. 1.

For example, the LCD 22 displays a condition setting screen 220 for inputting the allowed conditions (sheet type, basis weight, etc.) of the sheets allowed to be used for cleaning the fusing section. FIG. 3 shows an example of the condition setting screen 220. As shown in FIG. 3, a condition setting screen 220 displays a sheet type selecting button group 220*a*, a basis weight selecting button group 220*b*, a punched hole allowed input button 220*c*, an index sheet allowed input button 220*d*, a color sheet allowed input button 220*e*, and the like. The sheet type selecting button group 220*a* includes a plurality of operating buttons displaying various different sheet types respectively, and when an operating button is pushed down, the sheet type displayed in the operating button is stored in the condition file 142 of the memory section 14 as the sheet type of the sheet allowed to be used for cleaning the fusing section. The basis weight selecting button group 220*b* includes a plurality of operating buttons displaying various different basis weights respectively, and when an operating button is pushed down, the basis weight displayed in the operating button is stored in the condition file 142 of the memory section 14 as the basis weight of the sheet allowed to be used for cleaning the fusing section. When the punched hole allowed input button 220*c*, the index sheet allowed input button 220*d*, or the color sheet allowed input button 220*e* is pushed down, the information showing the punched hole is allowed, the information showing the index sheet is allowed, or the information showing the color sheet is allowed is stored in the condition file 142 of the memory section 14, respectively (see FIG. 2B).

The operating section 20 includes other various operating buttons such as numeric buttons and a start button (not shown), and the operating signals by operating the buttons are output from the operating controlling section 21 to the controlling section 11.

The scanner section 30 includes a scanner controlling section 31 and a scanner 32.

The scanner controlling section 31 receives controlling signals from the controlling section 11 and drives and controls the sections of the scanner 32. The scanner 32 includes platen glass, a CCD (Charge Coupled Device) and a light source. The scanner 32 scans an original document with a light source, focuses an image of the reflected light on a CCD (Charge Coupled Device), to perform an optoelectronic conversion, and thereby reads an image of the original document set in a predetermined position as an RGB signal. The read analog image signal is output to the reading processing section 15.

The printing controller section 40 includes a controller controlling section 41, a DRAM controlling IC 42, an image memory 43, and a LANIF 44.

The controller controlling section 41 centrally controls the operation of the sections of the printing controller section 40. The controller controlling section 41 converts the printing data input from the host computer 200 through the LANIF 44 to image data in a data format in which the image forming apparatus 100 can print the image with a predetermined page description language and outputs the data with the controlling data input from the host computer 200 to the DRAM controlling IC 42.

The DRAM controlling IC 42 outputs the printing data and controlling data received from the LANIF 44 to the controller controlling section 41. According to the instructions from the controller controlling section 41, the DRAM controlling IC 42 controls the temporary storage of the image data and controlling data input from the controller controlling section 41 in the image memory 43. The DRAM controlling IC 42 is connected to the DRAM controlling IC 16 of the main unit controlling section 10 through a PCI (Peripheral Components Interconnect) bus, and according to instructions from the controller controlling section 41, reads out the image data and controlling data from the image memory 43, and outputs the data to the DRAM controlling IC 16.

The image memory 43 is configured with a DRAM and temporarily stores the input data.

The LANIF 44 includes an NIC (Network Interface Card), modem, and the like and sends/receives data such as printing data and controlling data to/from the host computer 200 connected to a communication network N such as a LAN (Local Area Network). The data received from the host computer 200 is output to the DRAM controlling IC 42.

The printer section 50 includes a printer controlling section 51 and a printer 52.

The printer controlling section 51 receives a controlling signal from the controlling section 11 and controls the operation of the sections of the printer 52.

Based on the image data input from the controlling section 11, the printer 52 forms and outputs a toner image on the sheet by electrophotography.

Figure 4:
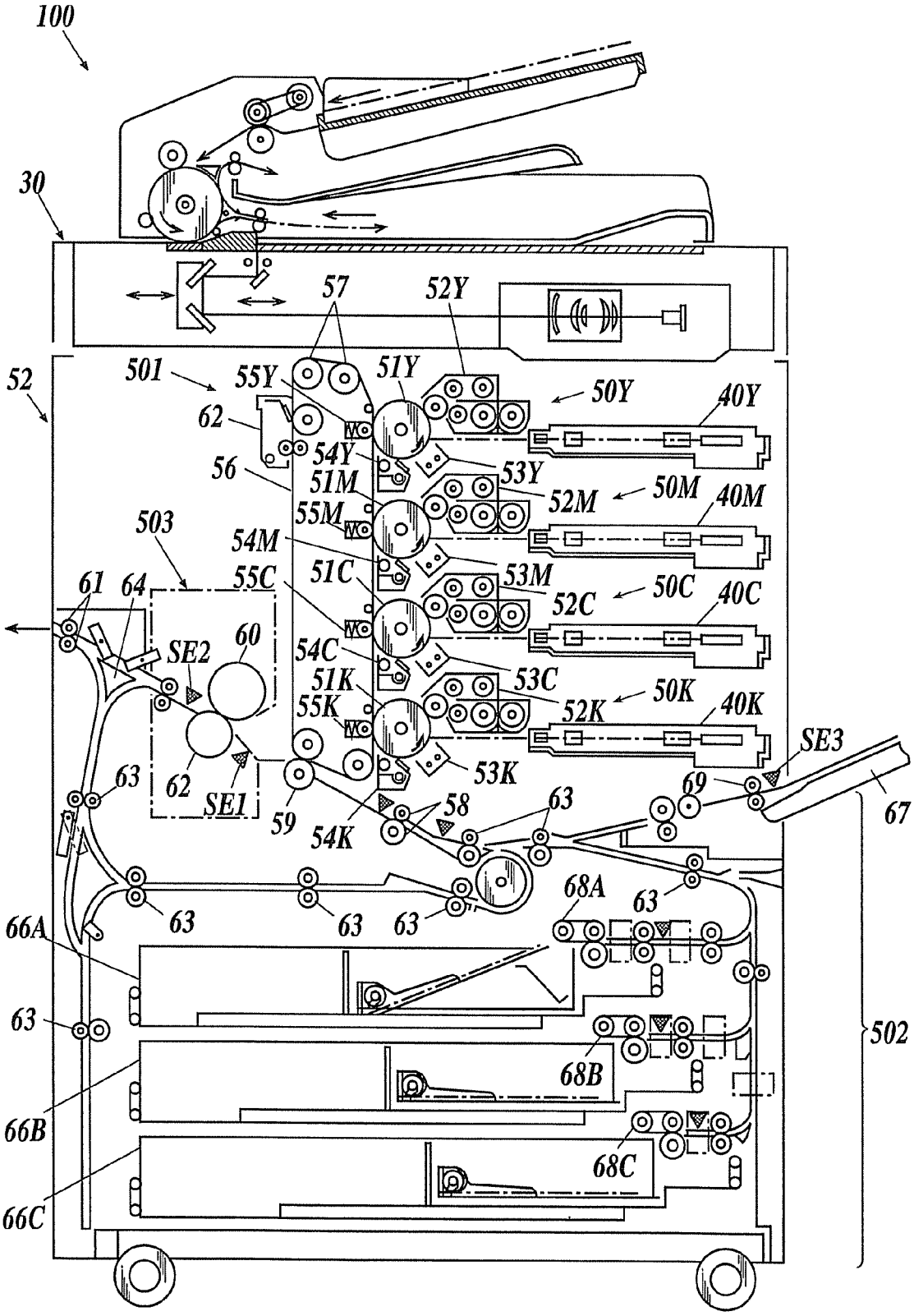
FIG. 4 is a diagram showing a main structure of a printer shown in FIG. 1.

FIG. 4 shows the structure of a main section of the printer 52. As shown in FIG. 4, the printer 52 includes an image forming section 501, a paper feeding section 502, and a fusing section 503.

The image forming section 501 includes writing units 40Y, 40M, 40C, and 40K for writing latent images of the images on photoconductive drums 51Y, 51M, 51C, and 51K by exposing the photoconductive drums with lasers based on the PWM signal input from the writing processing section 19. The image forming section 501 also includes photoconductive units 50Y, 50M, 50C and 50K for forming toner images of the colors Y, M, C, K, an intermediate transfer belt 56 as an intermediate transfer body, which is freely supported by the rollers 57 and carries toner images, formed on the photoconductive units 50Y, 50M, 50C and 50K to the sheet, a registration roller 58 for synchronizing with the toner images formed on the intermediate transfer belt 56 with the sheet and conveying it to a secondary transfer roller 59, and the secondary transfer roller 59 for transferring the toner images formed on the intermediate transfer belt 56 to the sheet. The photoconductive unit 50Y includes the photoconductive drum 51Y, developing device 52Y, charging device 53Y, cleaner 54Y and primary transfer roller 55Y. The photoconductive units 50M, 50C, and 50K have the same structure.

The sheet feeding section 502 includes sheet feeding trays 66A to 66C for storing sheets, sheet feeding rollers 68A to 68C for conveying sheets one by one from the sheet feeding trays 66A to 66C, a manual sheet feeding tray 67 and a manual sheet feeding roller 69 for conveying sheets one by one from the manual sheet feeding tray.

The fusing section 503 includes a heating roller 60 which is a heating component comprising a heating device inside such as a halogen lamp heater, an induction heater or the like and a pressure roller 62 which is a pressuring component imposed on the heating roller 60 to form a fusing nip portion.

The printer 52 is provided with a plurality of conveying rollers 63 for conveying the fed sheets along a predetermined conveying route inside the image forming apparatus 100 and the sheets fed from the sheet feeding section 502 are conveyed one by one on the conveying route. A sheet ejecting roller 61 for sending out the conveyed sheet is provided near a sheet ejecting opening and the sheet conveyed through the conveying route is ejected out from the ejecting opening.

Here, the image forming in the printer 52 is described. First, in the photoconductive unit 50Y, the photoconductive drum 51Y rotates, its surface is charged by the charging device 53Y, and a latent image of an image of Y data is formed in the charged area by exposure with the laser light source of the writing unit 40Y. The developing device 52Y forms a yellow toner image in the area of the latent image. The toner image is transferred to the intermediate transfer belt 56 by imposing the primary transfer roller 55Y (primary transferring). The toner image becomes the yellow image corresponding to the image data to be output. The toner which was not transferred is removed by the cleaner 54Y.

In the photoconductive units 50M, 50C, and 50K, a magenta toner image, a cyan toner image, and a black toner image are formed and transferred respectively with the same process. The rotation of the roller 57, the primary transfer rollers 55Y, 55M, 55C and 55K, and the secondary transfer roller 59 rotates the intermediate transfer belt 56 and the toner images of the colors YMCK are transferred and overlapped in order on the intermediate transfer belt 56. Any of the sheet feeding rollers 68A to 68C rotate so as to convey sheets one by one from any of the sheet feeding trays 66A to 66C and the registration roller 58 rotates so as to convey the sheet to the secondary transfer roller 59. The sheet passes through the imposing portion of the secondary transfer roller 59 and the toner images of the colors YMCK on the intermediate transfer belt 56 are transferred to the sheet (secondary transferring).

The sheet on which the toner images of the colors YMCK were transferred passes through the fusing section 503. The heating roller 60 and the pressure roller 62 of the fusing section 503 heats and presses the sheet while it is nipped with a fusing nip portion and conveyed, so that the toner images are melted and fused on the sheet. The sheet fused with the toner images by the fusing section 503 is ejected out by the sheet ejecting roller 61.

After the image is formed on the sheet, the belt cleaning section 62 removes the toner remaining on the intermediate transfer belt 56. Voltages of positive polarity and negative polarity are alternately applied to the secondary transfer roller 59 by a power source (not shown) for a predetermined amount of time and the toner adhered to the secondary transfer roller 59 is transferred back to the intermediate transfer belt 56 again so that the secondary transfer roller 59 is cleaned.

The sections of the above-described printer 52 are driven by various motors (not shown) under control of the printer controlling section 51. A plurality of sensors such as SE1, SE2, and SE3 are provided on the sheet conveying route. These sensors are connected to the printer controlling section 51. When a passing of the sheet is detected, a sheet detect signal is generated and then output to the printer controlling section 51. Based on the sheet detect signal output by these sensors, the printer controlling section 51 manages the conveying status and detects the occurring and relieving of a jam.

For example, when a front end of a sheet passes by a sensor and a sheet detect signal is output, but a sheet detect signal is not output within a predetermined time frame from the next sensor on the conveying route which the sheet is to pass through, a jam is detected between the two sensors and jam detect information including information on where the jam occurred is output to the controlling section 11. When a sheet detected signal continues to be output from a certain sensor for at least a predetermined amount of time, a jam is detected near the certain sensor and the jam detect information including information on where the jam occurred is output to the controlling section 11.

An open/close detecting sensor (not shown) which detects the opening and closing of the doors covering a front face of the image forming apparatus 100 is provided on the front face of the printer 52. The open/close detecting sensor is connected to the printer controlling section 51, and generates an open detect signal when a door is open which is then output to the printer controlling section 51. When the open detecting signals input after the jam occurs is no longer input, the printer controlling section 51 determines whether or not there is a sheet detect signal from the sensors provided on the conveying route. When the sheet detect signal is not input from any of the sensors, the printer controlling section 51 detects that the jam has been relieved and outputs jam relieve information to the controlling section 11.

Next, the operation of the present embodiment is described.

Figure 5:
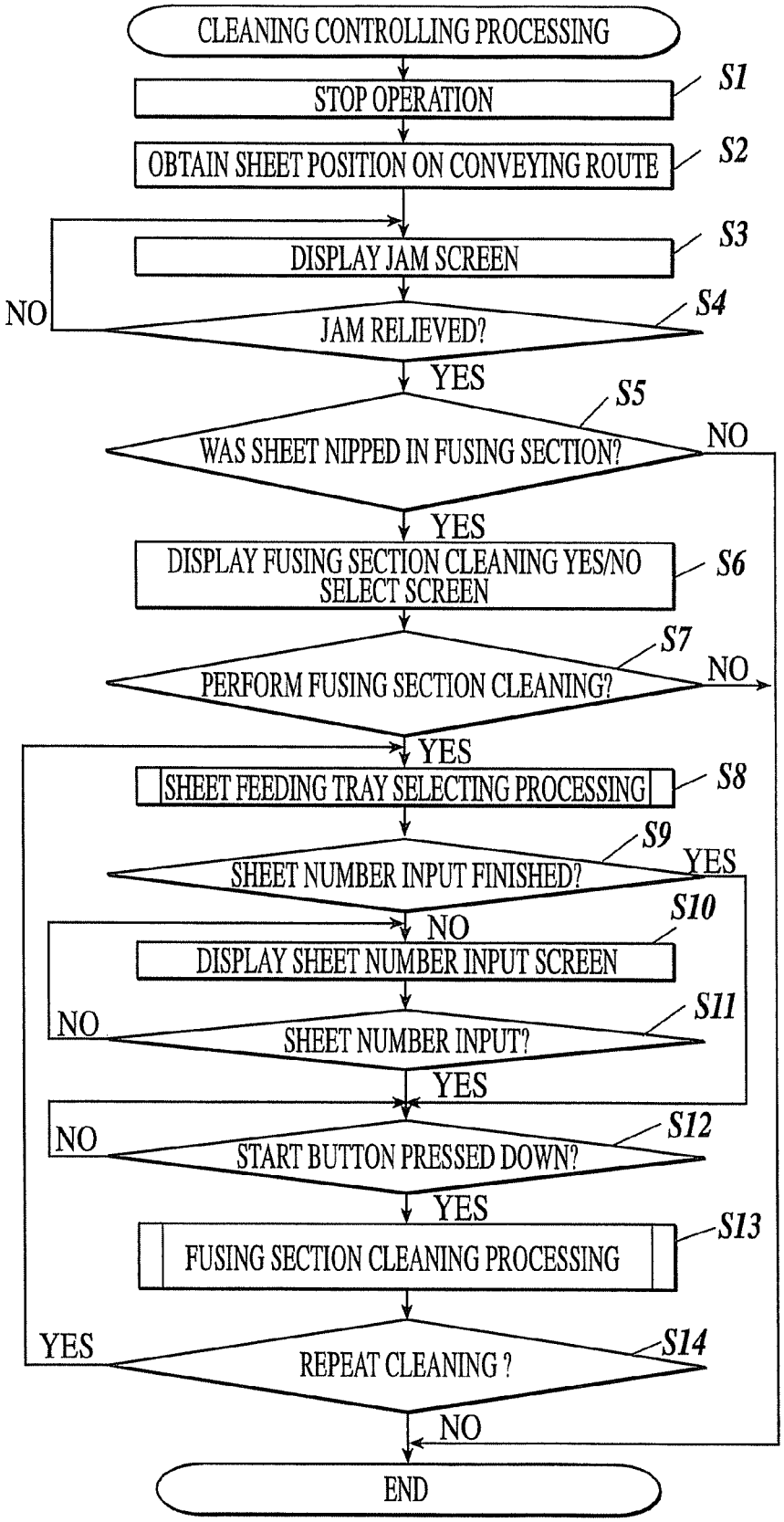
FIG. 5 is a flow chart showing a cleaning controlling processing performed by a controlling section shown in FIG. 1.

FIG. 5 shows the cleaning controlling processing performed by the controlling section 11 when jam detect information is input from the printer controlling section 51 during a printing operation.

When a jam occurs, the location of the jam included in the jam detect information is temporarily stored, and the operation of each section of the image forming apparatus 100 is stopped (step S1). Then, the location information of the sheet remaining on the conveying route is queried to the printer controlling section 51 and obtained therefrom (step S2). When the printer controlling section 51 receives the query of the location information of the sheet remaining on the conveying route, the location information of the sensor which is outputting the sheet detect signal after the operation is stopped is obtained and transmitted to the controlling section 11.

Figure 6:
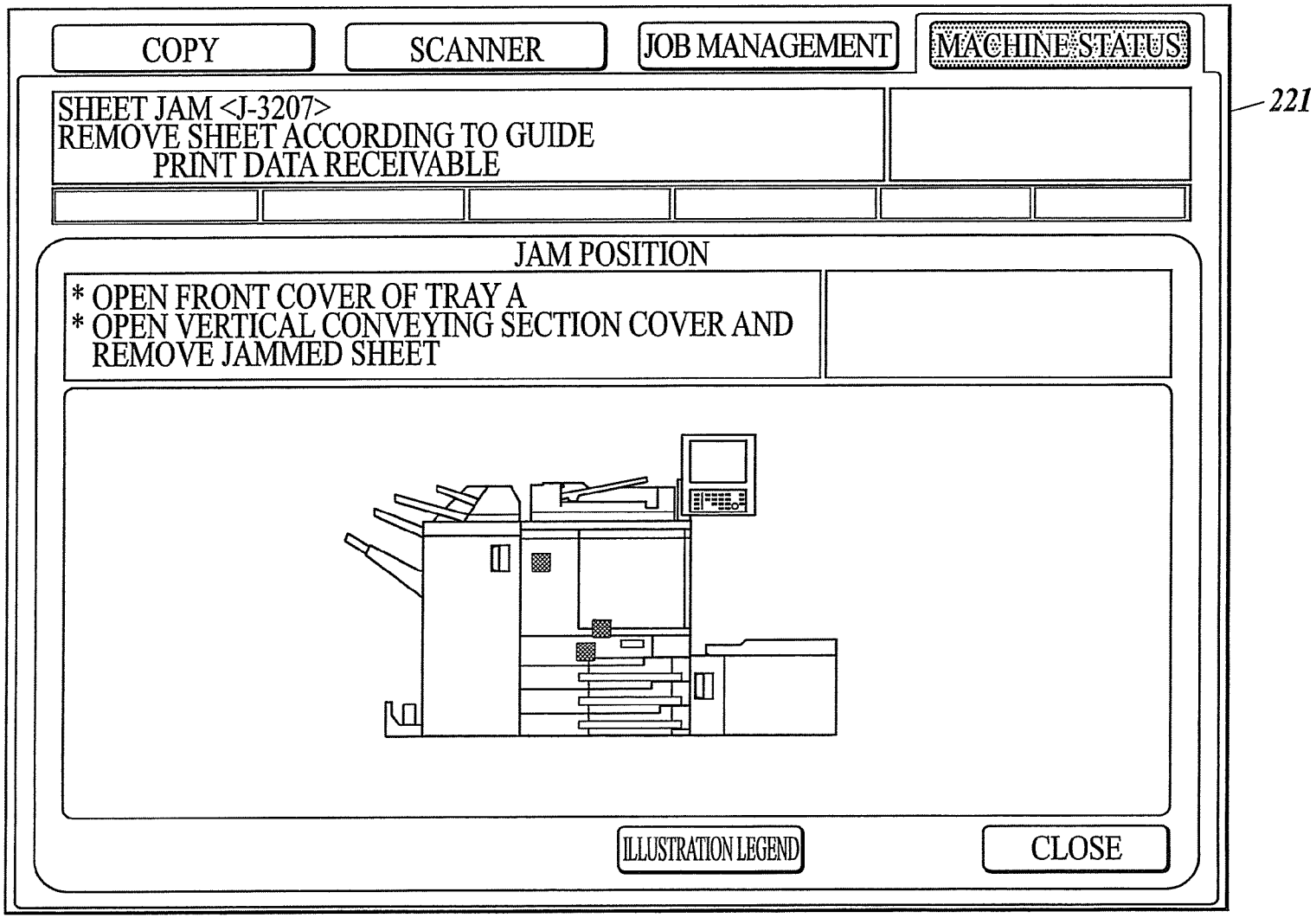
FIG. 6 is a diagram showing an example of a jam screen displayed on the LCD shown in FIG. 1.

Next, the obtained location information of the remaining sheet is temporarily stored and based on the jam detect information and the obtained location information of the remaining sheet, a jam screen 221 is displayed showing that a jam occurred, the location of the sheet to be removed (jam location and location of the remaining sheet), and the like (step S3). FIG. 6 is an example of the jam screen 221. A user settles the jam according to the jam screen 221. That is, the user opens the door corresponding to the sheet location shown on the jam screen 221, removes the sheet remaining in the location and then closes the door.

After the jam screen 221 is displayed, whether or not the jam relieve information is input from the printer controlling section 51 is determined, and when it is determined that the jam relieve information is not input (step S4; NO) the process returns to step S3. When it is determined that the jam relieve information is input (step S4; YES), the process advances to step S5.

In step S5, based on the location information of the remaining sheet obtained by the printer controlling section 51 in step S2, it is determined whether or not the sheet was nipped in the fusing section 503 when the operation stopped due to the occurrence of the jam (step S5). When the sheet detect signal was output from at least one of the sensors SE1 or SE2, it is determined that the sheet was nipped in the fusing section 503. When it is determined that the sheet was not nipped in the fusing section 503 when the operation stopped due to the occurrence of the jam (step S5; NO), the process ends. When it is determined that the sheet was nipped in the fusing section 503 when the operation stopped due to the occurrence of the jam (step S5; YES), a select screen 222 is displayed on the LCD 22 of the operating section 20 for selecting whether or not to instruct cleaning of the fusing section (step S6).

Figure 7A:
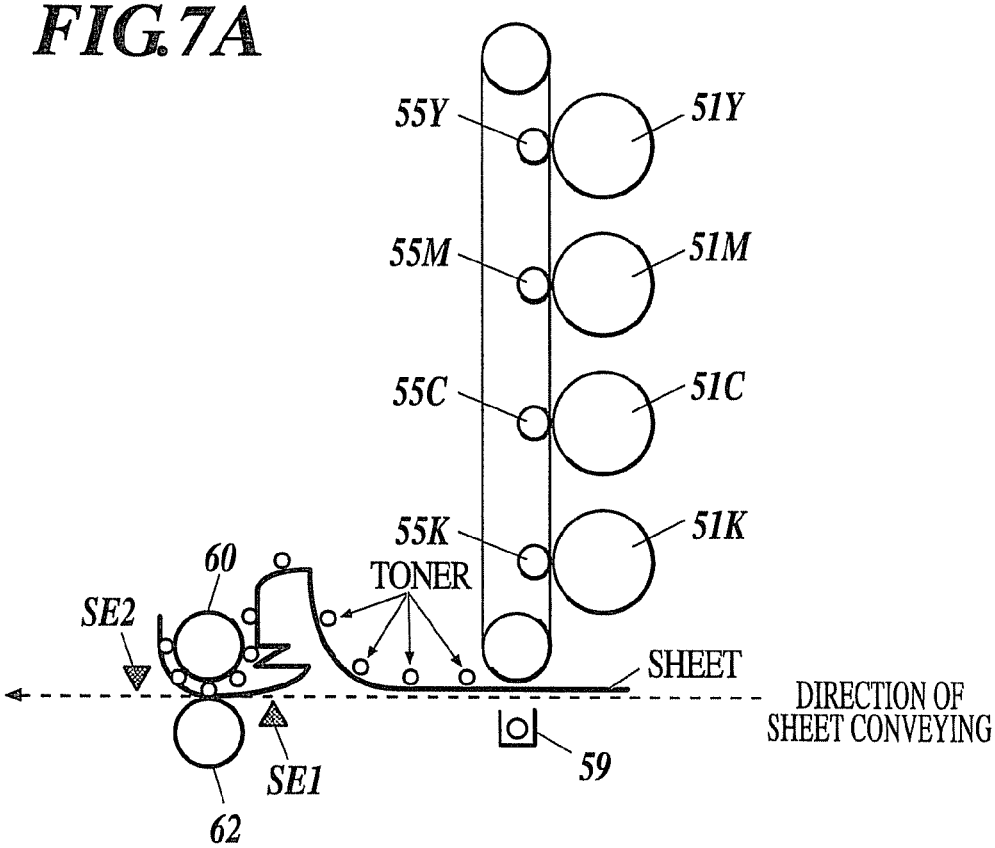
FIG. 7A is a diagram schematically showing a wrapping jam in which a sheet wraps around a heating roller of a fusing section.
Figure 7B:
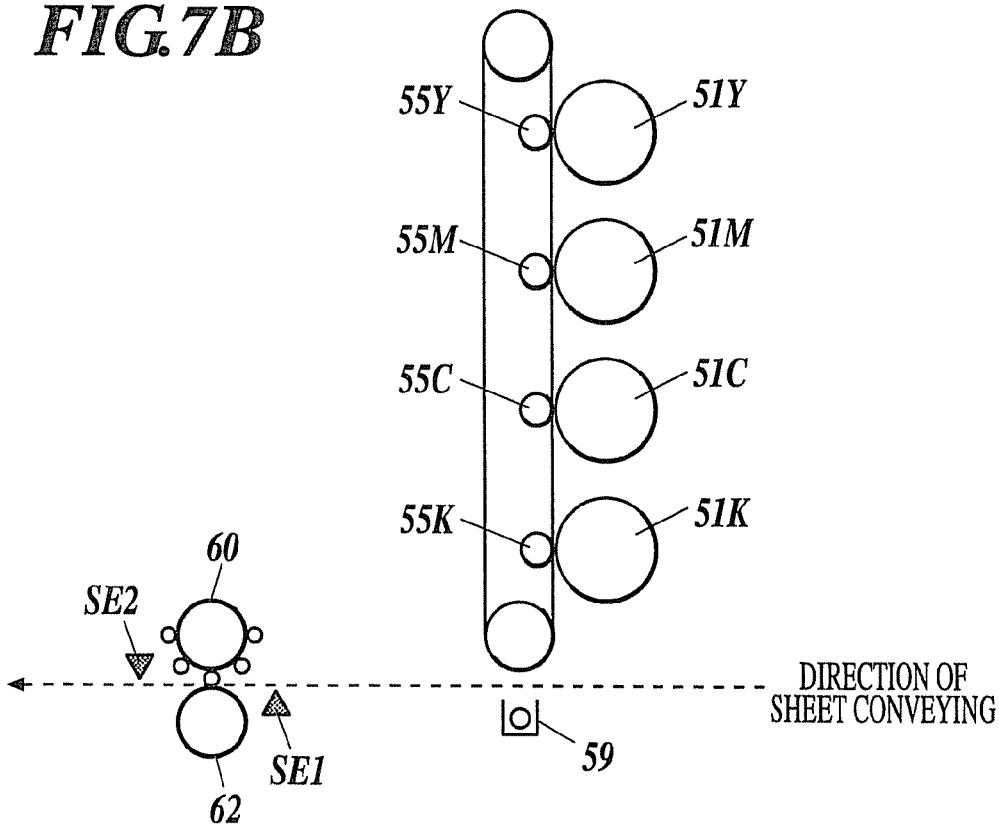
FIG. 7B is a diagram schematically showing unfused toner adhering on the fusing section by the jam shown in FIG. 7A.

FIG. 7A to FIG. 7B schematically show a jam in the fusing section 503. As shown in FIG. 7A, when a wrapping jam where the sheet wraps around the heating roller 60 of the fusing section 503 occurs, the sensor SE1 outputs the sheet detect signal for at least a predetermined amount of time, thus the printer controlling section 51 detects the jam. In this case, as shown in FIG. 7A, the unfused toner on the nipped sheet is adhered on the heating roller 60. Even when the jam is settled and the sheet is removed, the unfused toner remains adhered on the heating roller 60, as shown in FIG. 7B. This may also occur even when the jam occurs in a different section if the sheet is nipped in the fusing section 503 when the operation stops. As described above, when the printing is resumed with the unfused toner remaining on the heating roller 60, the residual toner may adhere on the face of the image of the sheet fed just after the printing is resumed, resulting in a stain in the image, or the residual toner may transfer from the heating roller 60 to the pressuring roller 62 and adheres to the back face of the sheet fed just after printing is resumed, resulting a stain in the back face of the sheet. Therefore, in the image forming apparatus 100, the select screen 222 is displayed on the LCD 22, and according to a user's selection, a new sheet is fed to the fusing section 503 and passed through, and the cleaning of the fusing section is performed.

Figure 8:
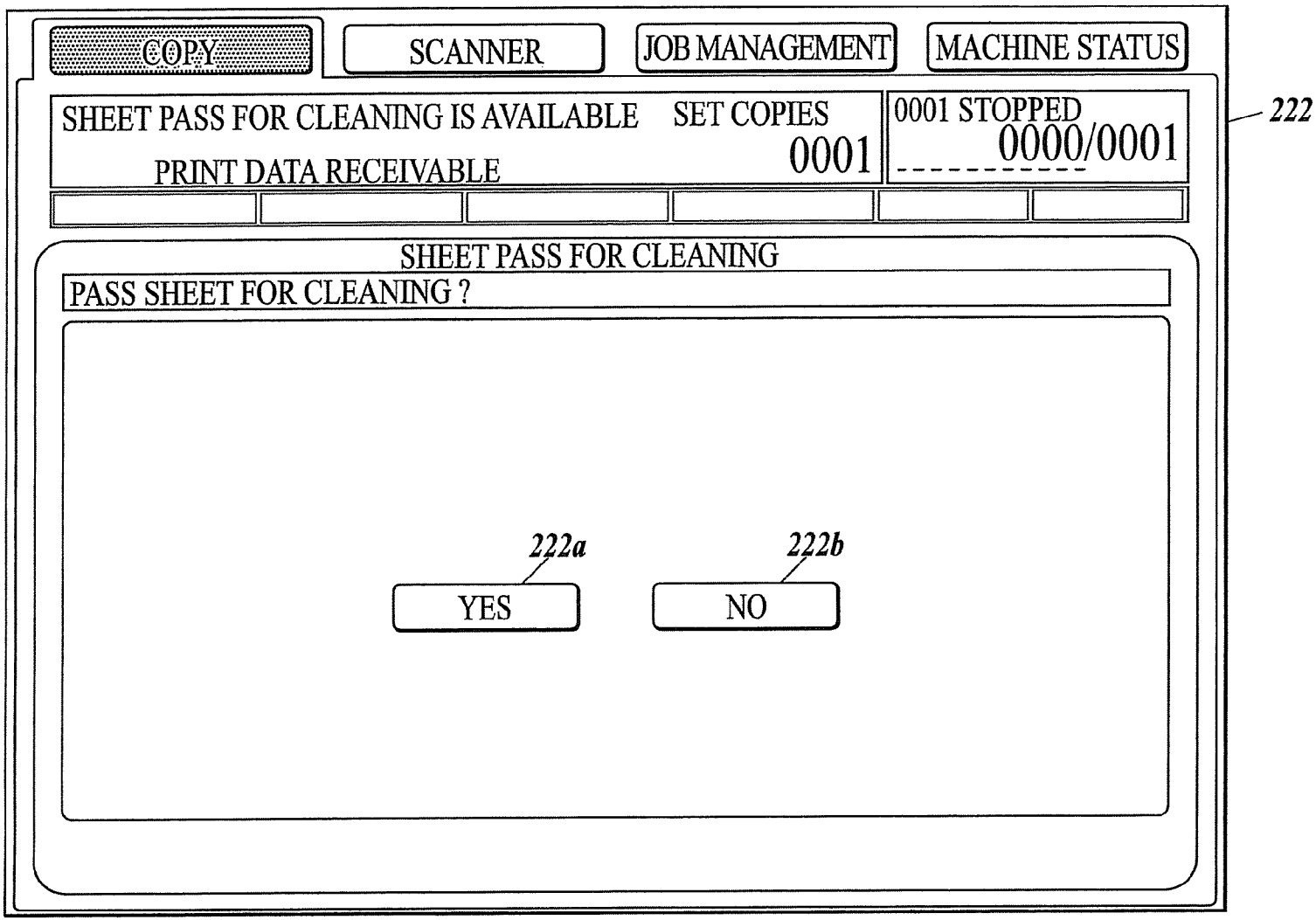
FIG. 8 is a diagram showing an example of a selecting screen displayed on the LCD shown in FIG. 1.

FIG. 8 shows an example of a select screen 222. As shown in FIG. 8, the select screen 222 displays a "Yes" button 222*a* for inputting an instruction to perform the cleaning of the fusing section and a "No" button 222*b* for inputting an instruction not to perform the cleaning of the fusing section.

When the "No" button 222*b* on the select screen 222 is pushed down and an instruction not to perform the cleaning of the fusing section is input (step S7; NO), the process ends. When the "Yes" button 222*a* on the select screen 222 is pushed down and an instruction to perform the cleaning of the fusing section is input (step S7; YES), the sheet feeding tray selecting processing is performed (step S8).

Figure 9:
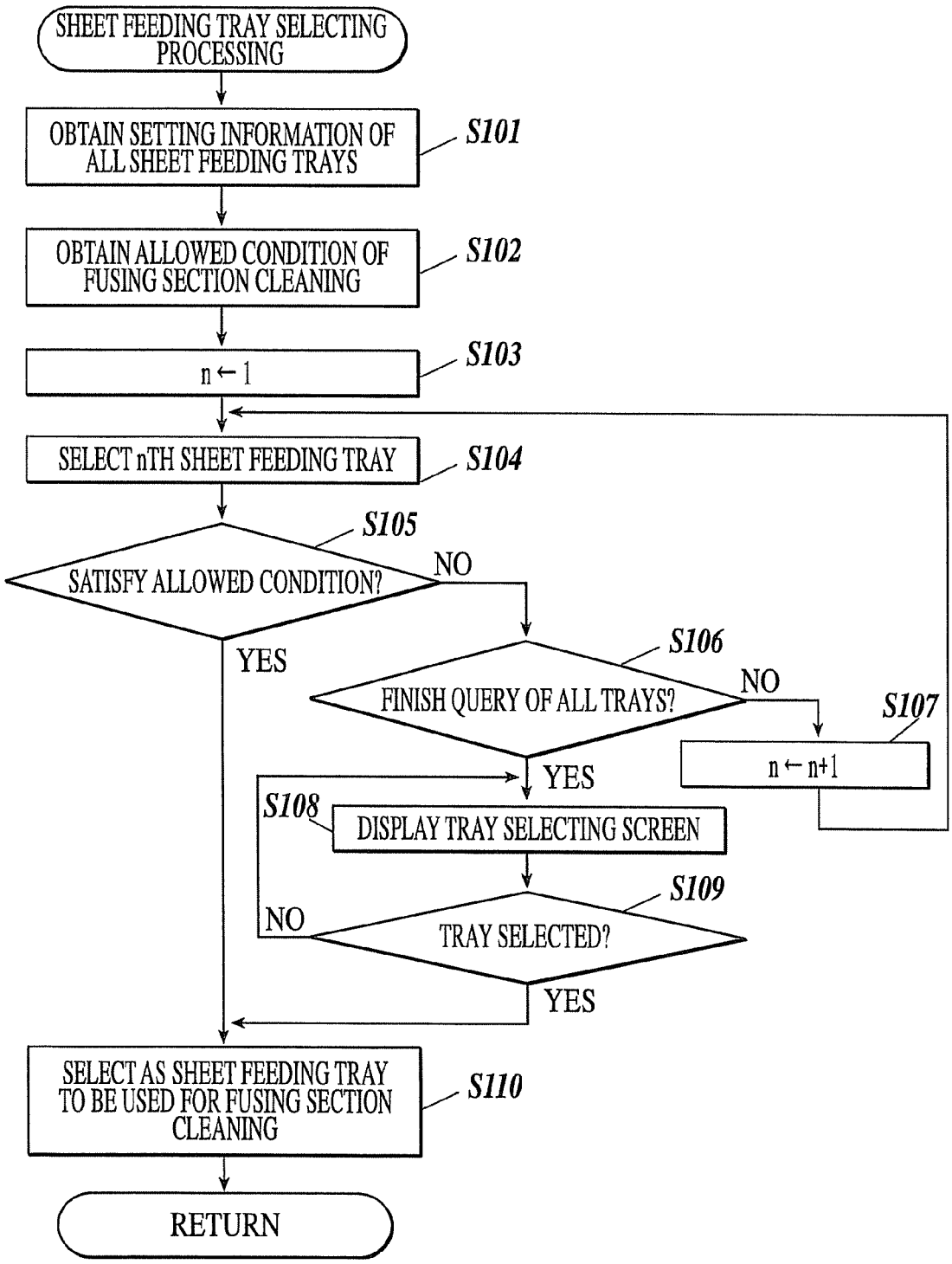
FIG. 9 is a flow chart showing a sheet feeding tray selecting processing performed by the controlling section shown in FIG. 1.

FIG. 9 shows the sheet feeding tray selecting processing performed by the controlling section 11.

In the sheet feeding tray selecting processing, first the tray file 141 (see FIG. 2A) stored in the memory section 14 is read out and the setting information of all the sheet feeding trays is obtained (step S101). Then, the condition file 142 (see FIG. 2B) stored in the memory section 14 is read out and the allowed conditions of the sheet allowed to be used in the cleaning of the fusing section is obtained (step S102).

Next, a count value n is set to 1 (step S103) and the sheet feeding tray which satisfies the allowed conditions stored in the condition file 142 is searched. That is, a nth sheet feeding tray is selected as the processing target (step S104) and it is determined whether or not the setting of the sheet feeding tray selected as the processing target satisfies the allowed conditions stored in the condition file 142 (step S105). When it is determined that the setting of the processing target sheet feeding tray does not satisfy the allowed conditions (step S105; NO), then it is determined whether or not n≧total number of sheet feeding trays, i.e. whether or not the query of all of the sheet feeding trays is finished. When it is determined that it is not n≧total number of sheet feeding trays or the query of all of the sheet feeding trays is not finished, (step S106; NO), the count value n is incremented by 1 (step S107) and the process returns to step S104.

In step S105, when it is determined that the setting of the processing target sheet feeding tray satisfies the allowed conditions (step S105; YES), this sheet feeding tray is determined to satisfy the allowed conditions and selected as the sheet feeding tray to be used in cleaning the fusing section (step S110), and the process advances to step S9 of FIG. 5.

In step S106, when n≧total number of sheet feeding trays, and it is determined that the query of all sheet feeding trays is finished (step S106; YES), a tray selecting screen 223 is displayed on the LCD 22 (step S108).

Figure 10:
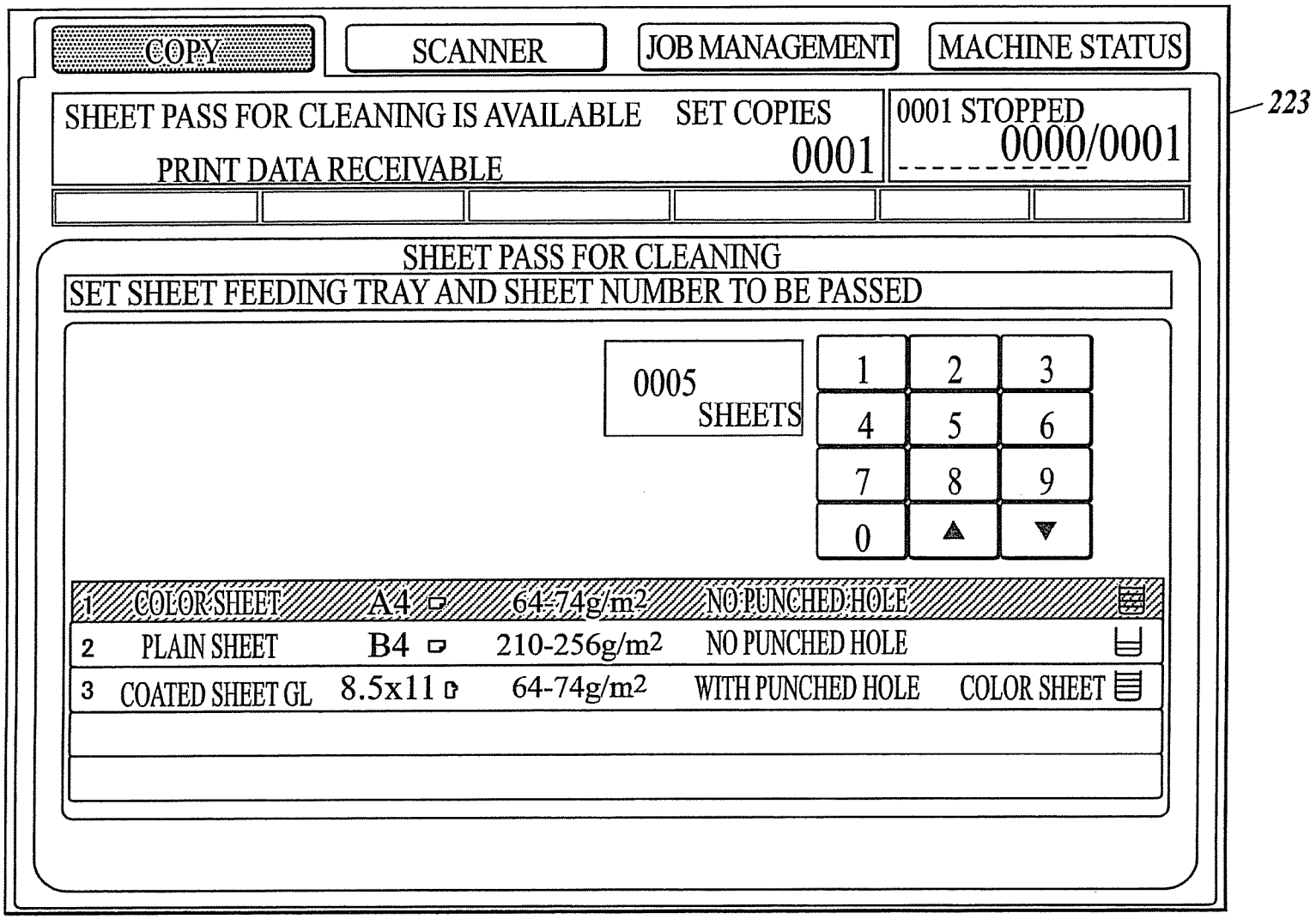
FIG. 10 is a diagram showing an example of a tray selecting screen displayed on the LCD shown in FIG. 1.

FIG. 10 shows an example of the tray selecting screen 223. On the tray selecting screen 223 of FIG. 10, a list of contents such as sheet type, sheet size, basis weight and punched hole presence of the sheets stored in the sheet feeding tray 66A to 66C is displayed based on the tray file 141 stored in the memory section 14. The tray selecting screen 223 also displays a numeric key pad, and the sheet number to be passed through during cleaning can also be input.

When any of the sheet feeding tray information is selected from the list displayed on the tray selecting screen 223 (step S109; YES), the selected sheet feeding tray is selected to be used in cleaning the fusing section (step S110), and the process advances to step S9 of FIG. 5.

In step S9 of FIG. 5, it is determined whether or not the sheet number to be passed has been already input. When it is determined that the sheet number has been already input (step S9; YES) the process advances to step S12, and when it is determined that the sheet number has not been input (step S9; NO), the input screen for inputting the sheet number to be passed is displayed on the LCD 22 (step S10) and when the sheet number is input (step S11; YES) the process advances to step S12.

Figure 11:
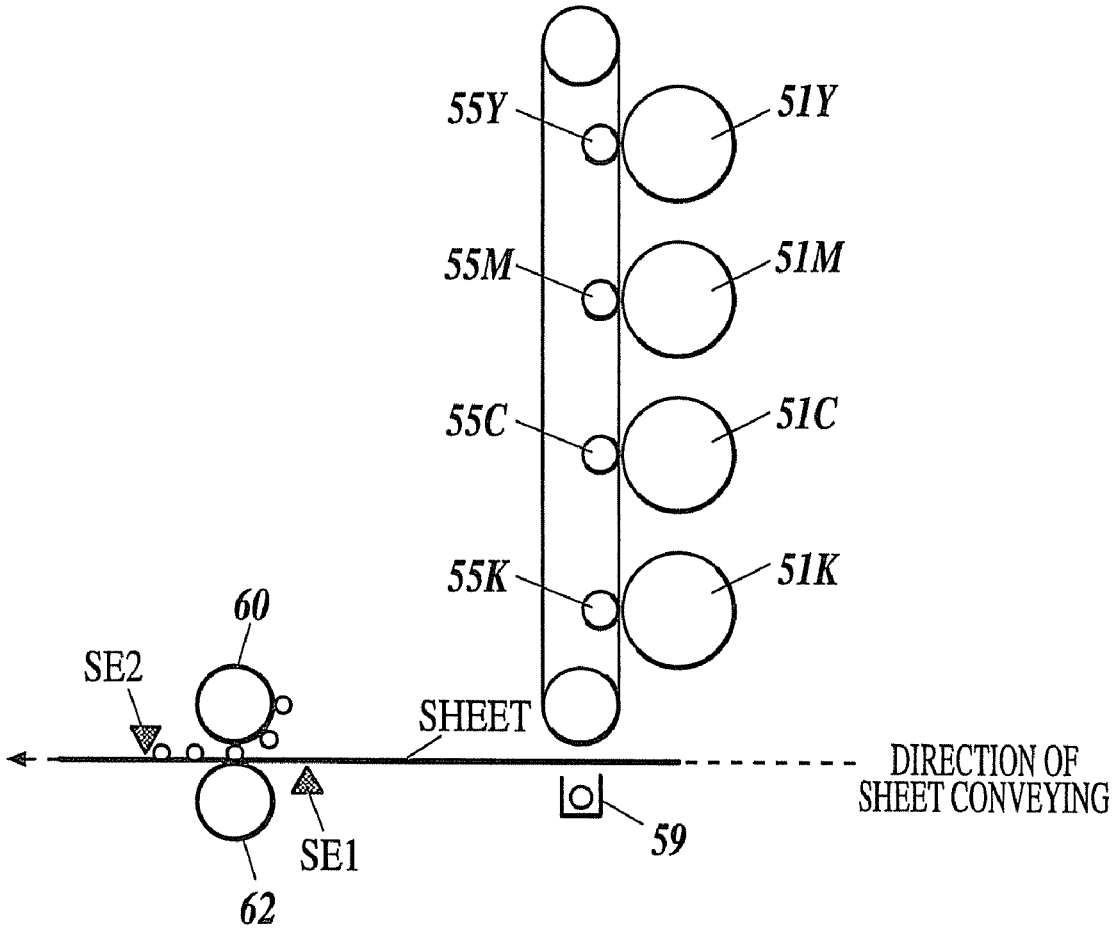
FIG. 11 is a diagram schematically showing a heating roller and pressuring roller shown in FIG. 4 being cleaned by passing a sheet and letting toner which is adhered to the heating roller and pressuring roller be adhered to the sheet.

In step S12, the process waits for pushing down of the start button of the processing section 20, and when the start button is pushed down (step S12; YES), the cleaning processing of the fusing section is performed (step S13). That is, the information on the selected sheet feeding tray and the instruction to clean the fusing section is transmitted to the printer controlling section 51. Then, according to the control of the printer controlling section 51, in the printer 52, the input number of sheets are fed one by one from the sheet feeding tray selected in the sheet feeding tray selecting processing and all of the rollers used to convey the sheets are driven so as to pass the fed sheets through the fusing section 503 and eject the sheets from the ejecting opening. With this, as shown in FIG. 11, the toner adhered on the heating roller 60 and the pressuring roller 62 is adhered onto the sheet which is passing through, thereby the heating roller 60 and the pressuring roller 62 is cleaned.

When the cleaning processing of the fusing section is finished, a screen querying whether or not to repeat the cleaning of the fusing section is displayed, and when another cleaning is instructed (step S14; YES), the process returns to step S8. When an instruction not to repeat the cleaning is input (step S14; NO), the process ends. After the process ends, the printing operation is resumed.

As described above, according to the image forming apparatus 100 of the first embodiment, in a case where a sheet is nipped in the fusing section 503 when a jam occurs, when cleaning of the fusing section is instructed by a user through the select screen 222 after the jam is relieved, a sheet feeding tray which stores the sheet allowed to be used in the cleaning of the fusing section predetermined on the condition setting screen 220 by a user, is searched, a sheet feeding tray storing the sheet which satisfies the allowed conditions is selected. The sheet from the selected sheet feeding tray is conveyed without forming an image and passed through the fusing section 503 for cleaning the fusing section.

Consequently, cleaning of the fusing section is performed by automatically feeding sheets from the sheet feeding tray storing the sheet which satisfies the allowed conditions such as the sheet type, basis weight, etc., allowed by the user. Therefore, even when expensive sheets and special sheets, which a user does not want to use for cleaning the fusing section, are stored in the sheet feeding tray, these sheets in cleaning the fusing section can be prevented from being unnecessarily used.

Second Embodiment

Next the second embodiment of the present invention is described. The structure of the image forming apparatus 100 of the second embodiment is the same as the structure described in the first embodiment, thus the description is omitted, and the operation of the second embodiment is described.

FIG. 12 shows the cleaning controlling processing (hereinafter referred to as cleaning controlling processing B) which is performed by the controlling section 11 when the jam detect information is input from the printer controlling section 51 during the printing operation.

The operation of steps S21 to S27 of the cleaning controlling processing B is the same as the steps S1 to S7 of the cleaning controlling processing described with FIG. 5, thus the description is omitted.

Figure 13:
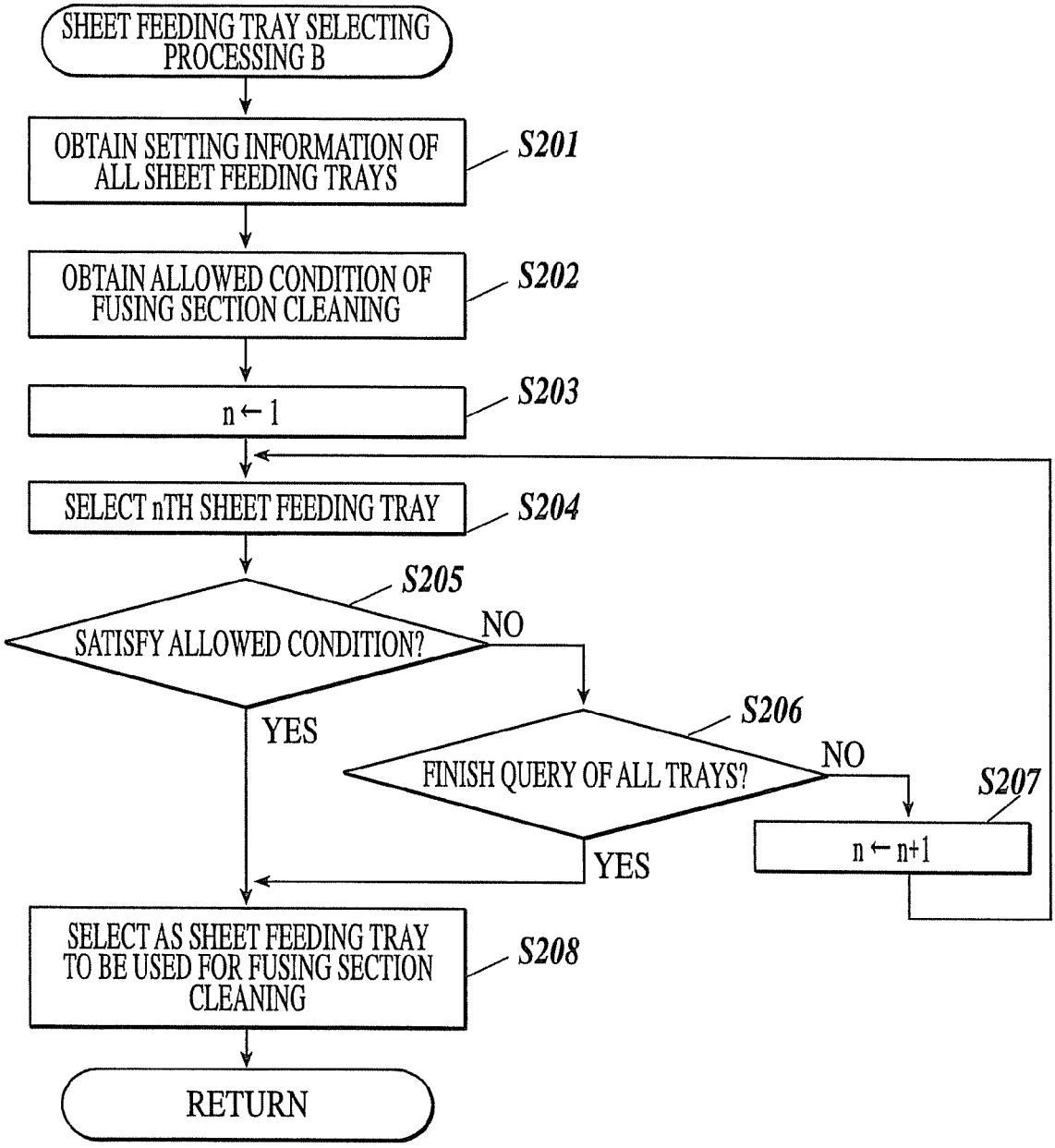
FIG. 13 is a flow chart showing a sheet feeding tray selecting processing B performed by the controlling section shown in FIG. 1.

In step S28, the sheet feeding tray selecting processing (hereinafter referred to as sheet feeding tray selecting processing B) is performed. FIG. 13 shows the sheet feeding tray selecting processing B performed by the controlling section 11.

In the sheet feeding tray selecting processing B, first the tray file 141 (see FIG. 2A) stored in the memory section 14 is read out and the setting information of all the sheet feeding trays is obtained (step S201). Then, the condition file 142 (see FIG. 2B) stored in the memory section 14 is read out and the allowed conditions of the sheet allowed to be used in the cleaning of the fusing section is obtained (step S202).

Next, a count value n is set to 1 (step S203) and the sheet feeding tray which satisfies the allowed conditions stored in the condition file 142 is searched. That is, a nth sheet feeding tray is selected as the processing target (step S204) and it is determined whether or not the setting of the sheet feeding tray selected as the processing target satisfies the allowed conditions stored in the condition file 142 (step S205). When it is determined that the setting of the processing target sheet feeding tray does not satisfy the allowed conditions (step S205; NO), then it is determined whether or not n≧total number of sheet feeding trays, i.e. whether or not the query of all of the sheet feeding trays is finished. When it is determined that it is not n≧total number of sheet feeding trays or the query of all of the sheet feeding trays is not finished, (step S206; NO), the count value n is incremented by 1 (step S207) and the process returns to step S204.

In step S205, when it is determined that the setting of the processing target sheet feeding tray satisfies the allowed conditions (step S205; YES), this sheet feeding tray is determined to satisfy the allowed conditions and selected as the sheet feeding tray to be used in cleaning the fusing section (step S208), and the process advances to step S29 of FIG. 12.

In step S206, when n≧total number of sheet feeding trays, and it is determined that the query of all sheet feeding trays is finished (step S206; YES), and the process advances to step S29 of FIG. 12.

In step S29 of FIG. 12, it is determined whether or not the sheet feeding tray storing the sheet which satisfies the allowed condition of the cleaning of the fusing section is selected in sheet feeding tray selecting processing B. When the sheet feeding tray which satisfies the allowed condition is not selected, that is, it is determined that there is no sheet feeding tray storing the sheet which satisfies the allowed condition (step S29; NO), a message for urging the setting of the sheet which satisfies the allowed condition of the cleaning of the fusing section in any one of the sheet feeding trays 66A to 66C is displayed on the LCD 22 (step S30). After the message is displayed, when the sheet which satisfies the allowed condition is set in the sheet feeding tray and the change of setting of the sheet feeding tray is input on the operating section 20 (step S31; YES), the process returns to step S28, and the sheet feeding tray selecting processing B is performed again. In step S29, when it is determined that there is a sheet feeding tray storing the sheets which satisfies the allowed conditions, (step S29; YES), the input screen for inputting the sheet number to be passed when cleaning the fusing section is displayed on the LCD 22 (step S32). When the sheet number to be passed through is input on the displayed input screen (step S33; YES) the process advances to step S34.

In step S34, the process waits for pushing down of the start button, and when the start button is pushed down (step S34; YES), the cleaning processing of the fusing section is performed (step S35). That is, the information on the selected sheet feeding tray and the instruction to clean the fusing section is transmitted to the printer controlling section 51. Then, according to the control of the printer controlling section 51, in the printer 52, the input number of sheets are fed one by one from the sheet feeding tray selected in the sheet feeding tray selecting processing B and all of the rollers used to convey the sheets are driven so as to pass the fed sheets through the fusing section 503 and eject the sheets from the ejecting opening. With this, as shown in FIG. 11, the toner adhered on the heating roller 60 and the pressuring roller 62 is adhered onto the sheet which is passing through, thereby the heating roller 60 and the pressuring roller 62 is cleaned.

When the cleaning processing of the fusing section is finished, a screen querying whether or not to repeat the cleaning of the fusing section is displayed, and when another cleaning is instructed (step S36; YES), the process returns to step S28. When an instruction not to repeat the cleaning is input (step S36; NO), the process ends. After the process ends, the printing operation is resumed.

As described above, according to the image forming apparatus 100 of the first embodiment, in a case where a sheet is nipped in the fusing section 503 when a jam occurs, when cleaning of the fusing section is instructed by a user through the select screen 222 after the jam is relieved, a sheet feeding tray which stores the sheet allowed to be used in the cleaning of the fusing section predetermined on the condition setting screen 220 by a user, is searched, a sheet feeding tray storing the sheet which satisfies the allowed conditions is selected. The sheet from the selected sheet feeding tray is conveyed without forming an image and passed through the fusing section 503 for cleaning the fusing section.

When a sheet feeding tray storing a sheet which satisfies the allowed condition allowing the sheet to be used in the cleaning of the fusing section, a message for urging the setting of the sheet which satisfies the allowed condition of the sheet allowed to be used in the cleaning of the fusing section in any one of the sheet feeding trays 66A to 66C is displayed on the LCD 22. When a sheet which satisfies the allowed condition is set, the sheet feeding tray storing the sheet which satisfies the allowed condition of the sheet allowed to be used in the cleaning of the fusing section is searched again, and the sheet feeding tray storing the sheet which satisfies the allowed condition is selected, and the sheet from the selected sheet feeding tray is conveyed without forming an image and passed through the fusing section 503 for cleaning the fusing section.

Consequently, cleaning of the fusing section is performed by automatically feeding sheets from the sheet feeding tray storing the sheet which satisfies the allowed conditions such as the sheet type, basis weight, etc., allowed by the user. Therefore, even when expensive sheets and special sheets, which a user does not want to use for cleaning the fusing section, are stored in the sheet feeding tray, these sheets in cleaning the fusing section can be prevented from being unnecessarily used.

When a sheet which satisfies the allowed conditions set by the user is not stored in the sheet feeding tray, a message urging the setting of the sheet which satisfies the allowed conditions of the cleaning of the fusing section in the sheet feeding tray is displayed on the LCD 22. Therefore, a user can recognize that the sheet which satisfies the allowed conditions is not stored and set the sheet which satisfies the allowed conditions in the sheet feeding tray which enables the cleaning of the fusing section with the sheets which satisfies the allowed conditions.

Third Embodiment

Next the third embodiment of the present invention is described. The structure of the image forming apparatus 100 of the third embodiment is the same as the structure described in the first embodiment, thus the description is omitted, and the operation of the third embodiment is described.

FIG. 14 shows the cleaning controlling processing (hereinafter referred to as cleaning controlling processing C) which is performed by the controlling section 11 when the jam detect information is input from the printer controlling section 51 during the printing operation.

The operation of steps S41 to S48 of the cleaning controlling processing C is the same as the steps S21 to S28 of the cleaning controlling processing B described with FIG. 12, thus the description is omitted.

In step S49, in the sheet feeding tray selecting processing B, it is determined whether or not the sheet feeding tray which satisfies the allowed conditions of the cleaning of the fusing section is selected. When the sheet feeding tray which satisfies the allowed conditions is selected, that is, it is determined that there is a tray which satisfies the allowed conditions (step S49; YES), the process advances to step S53.

When the sheet feeding tray which satisfies the allowed conditions is not selected, that is, it is determined that there is no sheet feeding tray which satisfies the allowed conditions (step S49; NO), a message for urging the setting of the sheet which satisfies the allowed condition of the cleaning of the fusing section in the manual sheet feeding tray 67 is displayed on the LCD 22 (step S50). After the message is displayed, when the sensor SE3 detects that the sheet is set in the manual sheet feeding tray 67 (step S51; YES), the manual sheet feeding tray 67 is selected as the sheet feeding tray for the cleaning of the fusing section, and the process advances to step S53.

In step S53, the input screen for inputting the sheet number to be passed during the cleaning of the fusing section is displayed on the LCD 22 (step S53). When the sheet number to be passed is input from the displayed input screen (step S54; YES) the process advances to step S55.

In step S55, the process waits for pushing down of the start button, and when the start button is pushed down (step S55; YES), the cleaning processing of the fusing section is performed (step S54). That is, the information on the selected sheet feeding tray and the instruction to clean the fusing section is transmitted to the printer controlling section 51. Then, in the printer 52, the input number of sheets is fed one by one from the selected sheet feeding tray and all of the rollers used to convey the sheets are driven so as to pass the fed sheets through the fusing section 503 and eject the sheets from the ejecting opening. With this, as shown in FIG. 11, the toner adhered on the heating roller 60 and the pressuring roller 62 is adhered onto the sheet which is passing through, thereby the heating roller 60 and the pressuring roller 62 is cleaned.

When the cleaning processing of the fusing section is finished, a screen querying whether or not to repeat the cleaning of the fusing section is displayed, and when another cleaning is instructed (step S57; YES), the process returns to step S48. When an instruction not to repeat the cleaning is input (step S57; NO), the process ends. After the process ends, the printing operation is resumed.

As described above, according to the image forming apparatus 100 of the first embodiment, in a case where a sheet is nipped in the fusing section 503 when a jam occurs, when cleaning of the fusing section is instructed by a user through the select screen 222 after the jam is relieved, a sheet feeding tray which stores the sheet allowed to be used in the cleaning of the fusing section predetermined on the condition setting screen 220 by a user, is searched, a sheet feeding tray storing the sheet which satisfies the allowed conditions is selected. The sheet from the selected sheet feeding tray is conveyed without forming an image and passed through the fusing section 503 for cleaning the fusing section.

When a sheet feeding tray storing a sheet which satisfies the allowed conditions allowing the sheet to be used in the cleaning of the fusing section, a message for urging the setting of the sheet which satisfies the allowed condition of the sheet allowed to be used in the cleaning of the fusing section in the manual sheet feeding tray 67 is displayed on the LCD 22. When a sheet which satisfies the allowed condition is set in the manual sheet feeding tray, the manual sheet feeding tray 67 is selected as the sheet feeding tray, and the sheet from the manual sheet feeding tray is conveyed without forming an image and passed through the fusing section 503 for cleaning the fusing section.

Consequently, cleaning of the fusing section is performed by automatically feeding sheets from the sheet feeding tray storing the sheet which satisfies the allowed conditions such as the sheet type, basis weight, etc., allowed by the user. Therefore, even when expensive sheets and special sheets, which a user does not want to use for cleaning the fusing section, are stored in the sheet feeding tray, of these sheets in cleaning the fusing section can be prevented from being unnecessarily used.

When a sheet which satisfies the allowed conditions set by the user is not stored in the sheet feeding tray, a message urging the setting of the sheet which satisfies the allowed conditions of the cleaning of the fusing section in the manual sheet feeding tray 67 is displayed on the LCD 22. Therefore, a user can recognize that the sheet which satisfies the allowed conditions is not stored and set the sheet which satisfies the allowed conditions in the manual sheet feeding tray which enables the cleaning of the fusing section with the sheets which satisfies the allowed conditions. The sheets for cleaning the fusing section is set in the manual sheet feeding section, thus troublesome operation such as taking out the sheets already stored in the sheet feeding trays 66A to 66C, setting sheets for cleaning the fusing section then setting the originally set sheets again after cleaning the fusing section is not necessary, which enhances the convenience.

Fourth Embodiment

Next, the fourth embodiment of the present invention is described.

The structure of the above described first to third embodiments enables a user to set a sheet type, basis weight, etc. of the sheet allowed to be used in the cleaning of the fusing section. In the present embodiment, a user can set a sheet type, basis weight, etc. of the sheet prohibited to be used in the cleaning of the fusing section.

Specifically, the structure of the image forming apparatus 100 of the fourth embodiment is the same as the structure of the first embodiment, but a condition setting screen 224 for setting prohibited conditions of the cleaning is displayed in the operating section 20 and the condition file 143 which stores the prohibited conditions of the cleaning is stored in the memory section 14 instead of the condition file 142.

Figure 15:
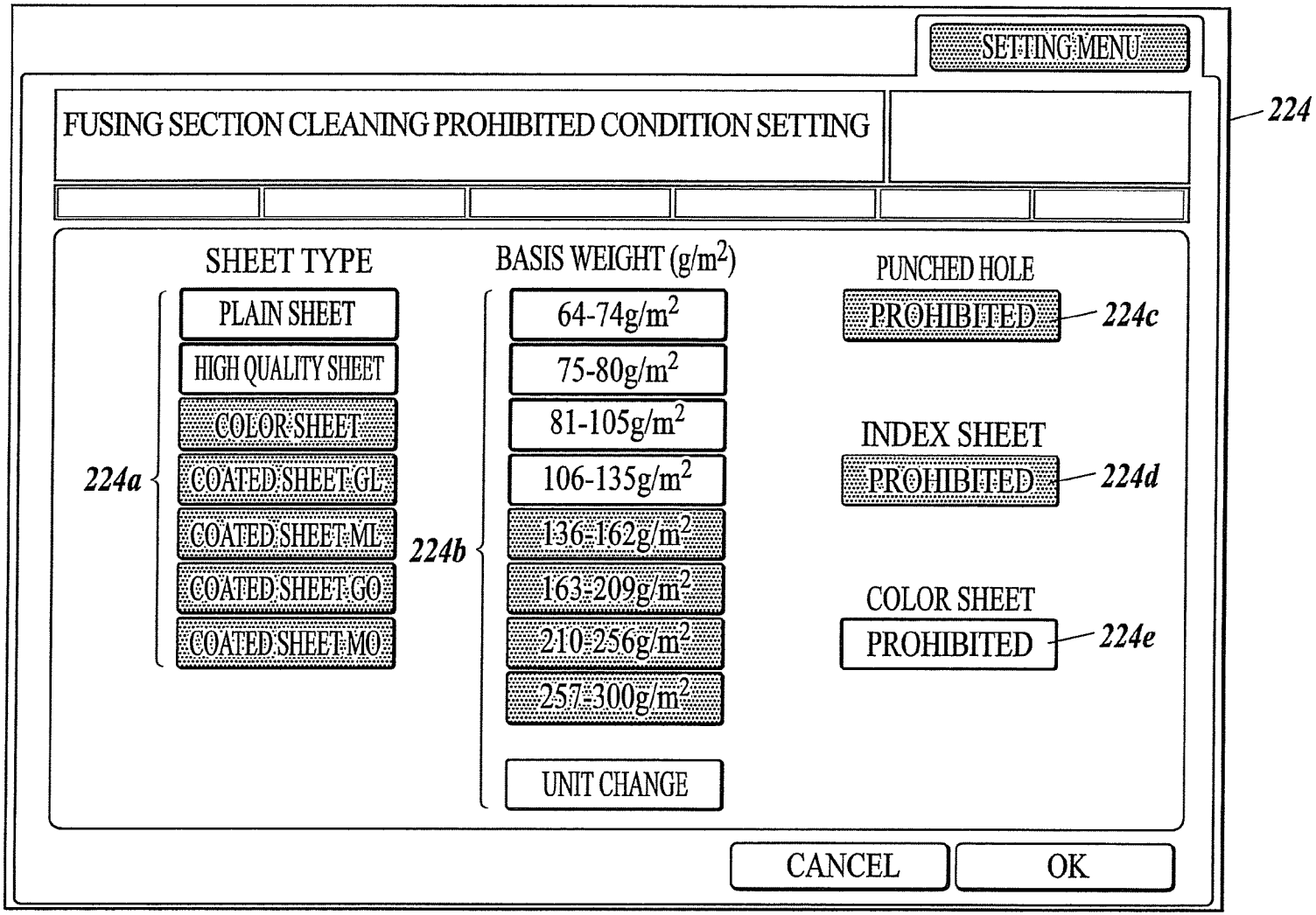
FIG. 15 is a diagram showing an example of a condition setting screen of a cleaning prohibited condition displayed on an LCD shown in FIG. 1.

FIG. 15 shows an example of a condition setting screen 224. The condition setting screen 224 is an operating screen for setting conditions of the sheet prohibited to be used in the cleaning of the fusing section. As shown in FIG. 15, a sheet type selecting button group 224*a*, a basis weight selecting button group 224*b*, a punched hole prohibited input button 224*c*, an index sheet prohibited input button 224*d*, and a color sheet prohibited input button 224*e* are displayed. The sheet type selecting button group 224*a* includes a plurality of operating buttons displaying various different sheet types respectively, and when an operating button is pushed down, the sheet type displayed in the operating button is stored in the condition file 143 of the memory section 14 as the sheet type of the sheet prohibited to be used for cleaning the fusing section. The basis weight selecting button group 224*b* includes a plurality of operating buttons displaying various different basis weights respectively, and when an operating button is pushed down, the basis weight displayed in the operating button is stored in the condition file 143 of the memory section 14 as the basis weight of the sheet prohibited to be used for cleaning the fusing section. When the punched hole prohibited input button 224*c*, the index sheet prohibited input button 224*d*, or the color sheet prohibited input button 224*e* is pushed down, the information showing the punched hole is prohibited, the information showing the index sheet is prohibited, or the information showing the color sheet is prohibited is stored in the condition file 143 of the memory section 14, respectively.

The condition file 143 is a file which stores conditions (sheet type, basis weight, punched hole, index sheet, and color sheet) of a sheet prohibited to be used in cleaning the fusing section which are set and input from a condition setting screen 224 on the operating section 20. The structure of the data storage is the same as shown in FIG. 2B, including items "sheet type", "basis weight", "punched hole", "index sheet", "color sheet", etc, but in the condition file 143, the information of the sheet type, basis weight, etc. prohibited to be used in the cleaning of the fusing section is stored.

The other structures are the same as those described in the first embodiment, thus the description is omitted.

Next, the operation of the fourth embodiment is described.

In the present embodiment, the cleaning controlling processing performed when the jam detect information is input from the printer controlling section 51 is the same as the cleaning controlling processing described in the first embodiment with reference to FIG. 5, but the contents of the operation of the sheet feeding tray selecting processing in step S8 is different from the first embodiment.

The sheet feeding tray selecting processing of the fourth embodiment (hereinafter referred to as sheet feeding tray selecting processing C) is described.

Figure 16:
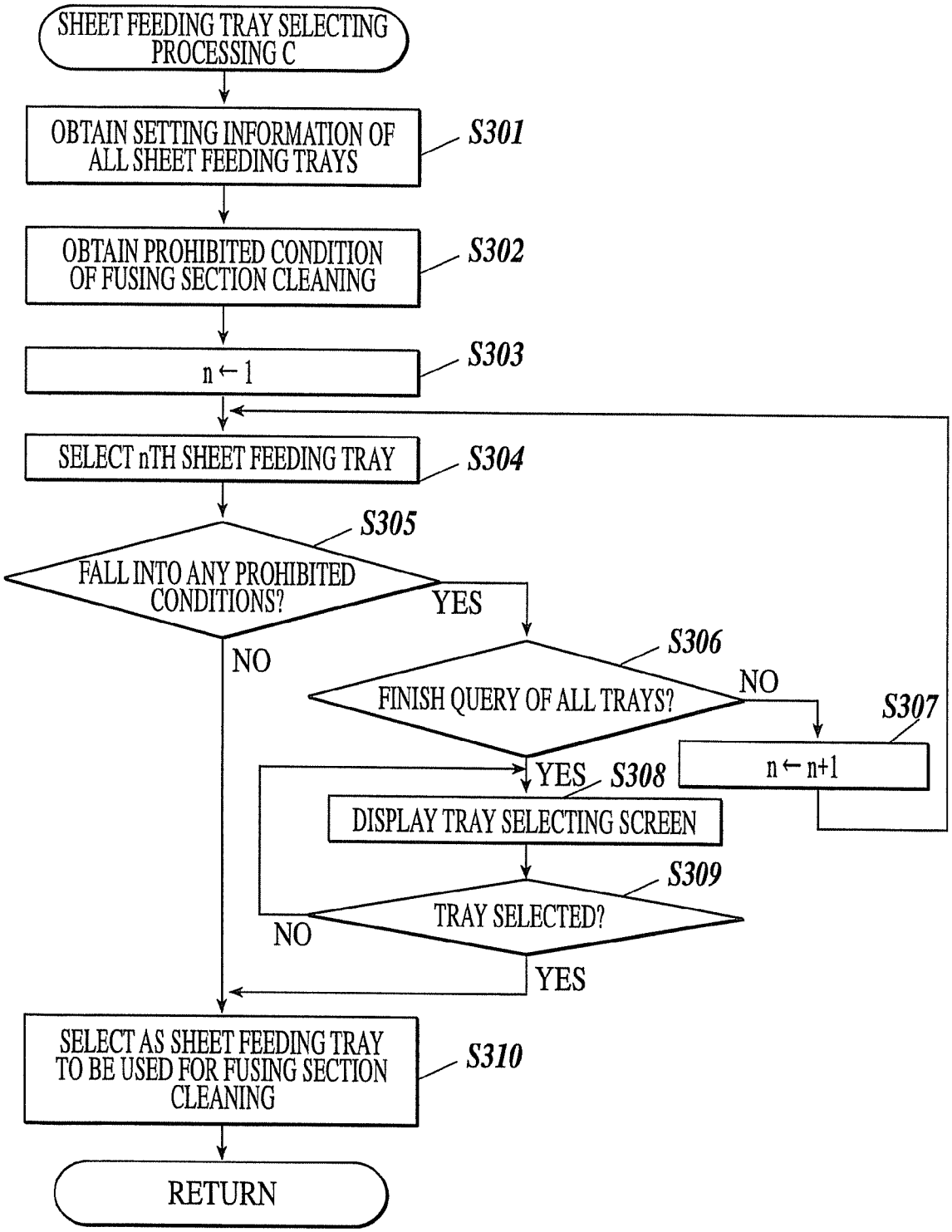
FIG. 16 is a flow chart showing a sheet feeding tray selecting processing C performed by the controlling section shown in FIG. 1.

FIG. 16 shows the sheet feeding tray selecting processing C performed by the controlling section 11.

In the sheet feeding tray selecting processing C, first the tray file 141 (see FIG. 2A) stored in the memory section 14 is read out and the setting information of all the sheet feeding trays is obtained (step S301). Then, the condition file 143 (see FIG. 2B) stored in the memory section 14 is read out and the prohibited conditions of the sheet prohibited to be used in the cleaning of the fusing section is obtained (step S302).

Next, a count value n is set to 1 (step S303) and the sheet feeding tray storing a sheet which does not fall into any of the prohibited conditions stored in the condition file 143 is searched. That is, a nth sheet feeding tray is selected as the processing target (step S304) and it is determined whether or not the setting of the sheet feeding tray selected as the processing target (that is, the contents of the sheet stored in the processing target sheet feeding tray) falls into any of the prohibited conditions stored in the condition file 143 (step S305). When it is determined that the setting of the processing target sheet feeding tray falls into any of the prohibited conditions (step S305; YES), then it is determined whether or not n≧total number of sheet feeding trays, i.e. whether or not the query of all of the sheet feeding trays is finished. When it is determined that it is not n≧total number of sheet feeding trays or the query of all of the sheet feeding trays is not finished, (step S306; NO), the count value n is incremented by 1 (step S307) and the process returns to step S304.

In step S305, when it is determined that the setting of the processing target sheet feeding tray does not fall into any of the prohibited conditions (step S305; NO), this sheet feeding tray determined not to fall into any of the prohibited conditions is selected as the sheet feeding tray to be used in cleaning the fusing section (step S310) and the process advances to step S9 of FIG. 5.

In step S306, when n≧total number of sheet feeding trays, and it is determined that the query of all sheet feeding trays is finished (step S306; YES), a tray selecting screen 223 is displayed on the LCD 22 (step S308).

When any of the sheet feeding tray information is selected from the list displayed on the tray selecting screen 223 (step S309; YES), the selected sheet feeding tray is selected as the sheet feeding tray used in cleaning the fusing section (step S310), and the process advances to step S9 of FIG. 5.

From the step S9 of FIG. 5 and after, the processing is performed the same as described in the first embodiment.

As described above, according to the image forming apparatus 100 of the fourth embodiment, in a case where a sheet is nipped in the fusing section 503 when a jam occurs, when cleaning of the fusing section is instructed by a user through the select screen 222 after the jam is relieved, a sheet feeding tray, which stores the sheet which does not fall into any of the prohibited conditions prohibited to be used in the cleaning of the fusing section predetermined on the condition setting screen 224 by a user, is searched, a sheet feeding tray storing the sheet which does not fall into any of the prohibited conditions is selected. The sheet from the selected sheet feeding tray is conveyed without forming an image and passed through the fusing section 503 for cleaning the fusing section.

Consequently, cleaning of the fusing section is performed by automatically feeding sheets from the sheet feeding tray set with the sheet which does not fall into any of the prohibited conditions such as the sheet type, basis weight, etc., prohibited to be used in cleaning the fusing section by the user. Therefore, even when expensive sheets and special sheets, which a user does not want to use for cleaning the fusing section, are set in the sheet feeding tray, these sheets in cleaning the fusing section can be prevented from being unnecessarily used.

The first to fourth embodiments have been described, however, the contents described in the above described embodiments are suitable examples of the image forming apparatus 100 of the present invention and it is not limited to these embodiments.

For example, in the above described fourth embodiment, as a result of the query of the sheet feeding trays, when a sheet feeding tray storing a sheet which does not fall into any of the prohibited conditions of the sheet prohibited to be used preset by a user on the condition setting screen 224 is not found, a message urging the setting in the sheet feeding tray a sheet which does not fall into any of the prohibited conditions in cleaning of the fusing section may be displayed on the LCD 22. Alternatively, a message urging the setting in the manual sheet feeding tray a sheet which does not fall into any of the prohibited conditions of the cleaning of the fusing section may be displayed on the LCD 22.

The details of the structure of the devices and the details of the operation of the image forming apparatus 100 may be changed accordingly within the scope of the present invention.

The present U.S. patent application claims priority under the Paris Convention of Japanese Patent Application No. 2007-017856 filed on Jan. 29, 2007 to the Japanese Patent Office, which shall be a basis for correcting mistranslations.

What is claimed is:

1. An image forming apparatus which forms an image on a sheet comprising:

a sheet feeding tray to store a sheet;

an image forming section to form a toner image on the sheet fed from the sheet feeding tray;

a fusing section to fuse the toner image on the sheet;

a controlling section to perform cleaning of the fusing section when a sheet has been nipped in the fusing section at a time of occurrence of a jam by passing a sheet from the sheet feeding tray through the fusing section after the jam is relieved;

an operating section to set an allowed condition including a sheet type and basis weight of an allowed sheet to be used for cleaning the fusing section; and a memory section to store the allowed condition including the sheet type and basis weight set on the operating section, wherein the controlling section determines whether or not the sheet feeding tray stores a sheet which satisfies the allowed condition stored in the memory section when cleaning of the fusing section is performed, and when the sheet feeding tray stores the sheet which satisfies the allowed condition, the controlling section selects the sheet feeding tray and controls the sheet feeding tray to feed the sheet from the selected sheet feeding tray and controls the fusing section to pass the sheet through the fusing section.

2. The image forming apparatus of claim 1, further comprising a display section, wherein when the controlling section determines the sheet feeding tray does not store the sheet which satisfies the allowed condition, the controlling section controls the display section to display a screen which urges setting of the sheet which satisfies the allowed condition in the sheet feeding tray.

3. The image forming apparatus of claim 1, further comprising a display section, wherein when the controlling section determines the sheet feeding tray does not store the sheet which satisfies the allowed condition, the controlling section controls the display section to display a screen which urges setting of the sheet which satisfies the allowed condition in the manual sheet feeding tray.

4. An image forming apparatus which forms an image on a sheet comprising:

a sheet feeding tray to store a sheet;

an image forming section to form a toner image on the sheet fed from the sheet feeding tray;

a fusing section to fuse the toner image on the sheet;

a controlling section to perform cleaning of the fusing section when a sheet has been nipped in the fusing section at a time of occurrence of a jam by passing a sheet from the sheet feeding tray through the fusing section after the jam is relieved;

an operating section to set a prohibited condition including a sheet type and basis weight of a prohibited sheet not to be used for cleaning the fusing section; and a memory section to store the prohibited condition including the sheet type and basis weight set on the operating section, wherein the controlling section determines whether or not the sheet feeding tray stores a sheet which does not fall into the prohibited condition stored in the memory section when cleaning of the fusing section is performed, and when the sheet feeding tray stores the sheet which does not fall into the prohibited condition, the controlling section selects the sheet feeding tray and controls the sheet feeding tray to feed the sheet from the selected sheet feeding tray and controls the fusing section to pass the sheet through the fusing section.

* * * * *